US006673118B2

(12) United States Patent
DuVal et al.

(10) Patent No.: US 6,673,118 B2
(45) Date of Patent: Jan. 6, 2004

(54) METHOD FOR REFRESHING, DEODORIZING AND FINISHING GARMENTS

(75) Inventors: Dean Larry DuVal, Lebanon, OH (US); Paul Eugene Rienzo, Cincinnati, OH (US); Kofi Ofosu-Asante, Cincinnati, OH (US); Ricky Ah-Man Woo, Hamilton, OH (US); Kimberly Ann Grimm, Mason, OH (US); Eric Laurence Wagnon, Cincinnati, OH (US)

(73) Assignee: Procter & Gamble Company, Cincinnati, OH (US)

( * ) Notice: Subject to any disclaimer, the term of this patent is extended or adjusted under 35 U.S.C. 154(b) by 321 days.

(21) Appl. No.: 09/932,224

(22) Filed: Aug. 17, 2001

(65) Prior Publication Data

US 2002/0040504 A1 Apr. 11, 2002

Related U.S. Application Data

(60) Provisional application No. 60/226,425, filed on Aug. 18, 2000.

(51) Int. Cl.[7] ..... D06C 29/00

(52) U.S. Cl. ..... 8/115.51; 8/115.6; 8/147

(58) Field of Search ..... 8/115.51, 115.6, 8/115.7, 116.1, 127.5, 147, 158, 159

(56) References Cited

U.S. PATENT DOCUMENTS

| | | | | |
|---|---|---|---|---|
| 4,014,105 | A | 3/1977 | Furgal et al. | 34/12 |
| 4,982,467 | A | 1/1991 | Mizusawa et al. | 8/158 |
| 5,670,475 | A | 9/1997 | Trinh et al. | 510/470 |
| 6,384,005 | B1 * | 5/2002 | Woo et al. | 510/328 |
| 6,500,212 | B1 * | 12/2002 | Rodrigues et al. | 8/186 |
| 2003/0126691 | A1 * | 7/2003 | Gerlach et al. | 8/158 |

FOREIGN PATENT DOCUMENTS

| | | |
|---|---|---|
| EP | 0 953 669 A2 | 11/1999 |
| WO | WO 00/24851 | 5/2000 |

* cited by examiner

*Primary Examiner*—Randy Gulakowski
*Assistant Examiner*—Joseph L Perrin
(74) *Attorney, Agent, or Firm*—Caroline Wei-Bark; C. Brant Cook; Kim W. Zerby

(57) ABSTRACT

The present invention relates to methods for selection and treatment of a garment with a refreshing, deodorizing and finishing composition, in order to improve various properties of garments, in particular, reduction or removal of unwanted wrinkles, odors, and the like. Also included is an article of manufacture containing a plurality of refreshing, deodorizing and finishing compositions in a plurality of disposable containers in association with instructions for their use in an apparatus.

12 Claims, 2 Drawing Sheets

METHOD FOR REFRESHING, DEODORIZING AND FINISHING GARMENTS

CROSS REFERENCE TO RELATED APPLICATION

This application claims the benefit of U.S. Provisional Application No. 60/226,425, filed Aug. 18, 2000.

FIELD OF THE INVENTION

The present invention relates to methods for selection and treatment of a garment with a refreshing, deodorizing and finishing composition, in order to improve various properties of garments, in particular, reduction or removal of unwanted wrinkles, odors, and the like. Also included is an article of manufacture containing a plurality of refreshing, deodorizing and finishing compositions in a plurality of disposable containers in association with instructions for their use in an apparatus.

BACKGROUND OF THE INVENTION

There exists today a bewildering array of clothing styles. Likewise, an apparently endless selection of fabrics and materials is available to the garment industry, each fabric seemingly having unique care and treatment requirements. These care and treatment requirements are especially troubling for garments that are otherwise clean but have been used or are tired in appearance. Drycleaning a garments is costly and time consuming, but leaves the garment with a noticible unpleasant odor. Alternatively, ironing the article may seem to be a possible solution. However, the style or material the garment is made of may make ironing difficult or even cause irreversible damage to the garment.

Clearly, there is a need for a system of refreshing, deodorizing and finishing garements used or tired in appearance which takes in to account both the style and material(s) of the garment to produce a good appearance through a simple, convenient process.

SUMMARY OF THE INVENTION

The present invention relates to a prcoess for refreshing, deodorizing and finishing garements used or tired in appearance which takes in to account both the style and material(s) of the garment to produce a good appearance through a simple, convenient process.

In accordance with a first aspect of the present invention, a method for selection and treatment of a garment with a refreshing, deodorizing and finishing composition is provided. The method comprises at least of the steps of:

(a) identifying the apparel characteristics of said garment;

(b) identifying the finish desired for said garment; and (c) identifying at least one refreshing, deodorizing and finishing composition appropriate for the apparel characteristics identified in (a) and the finish identified in (b) of said garment;

(d) selecting an appropriate refreshing, deodorizing and finishing composition; and (e) treating said garment with an effective amount of the appropriate refreshing, deodorizing and finishing composition selected in (d).

In accordance with a second aspect of the present invention, a garment in association with a garment care label is provided. The garment in association with a garment care label comprises a non-verbal visual cue, which assists in versioning said article in preparation for a treatment selected from the group consisting of soft finish and crisp finish.

In accordance with a third aspect of the present invention, an article of manufacture for refreshing, deodorizing and finishing a garment in an apparatus is provided. The article comprises (a) a first refreshing, deodorizing and finishing composition, wherein said first composition comprises:
  (i) a carrier comprising water and optionally low molecular weight alcohols and polyols, more preferably ethanol, methanol, propanol and mixtures thereof;
  (ii) an effective amount to absorb or reduce malodor, of odor control agent; and
  (iii) an effective amount of a wrinkle reducing active, preferably a polymer comprising carboxylic acid moieties, (more preferably homopolymers);
  wherein said composition has a pH of from about 3 to about 7 and a viscosity of less than about 100 cP;

(b) a first container, wherein said first composition is contained therein;

(c) a second refreshing, deodorizing and finishing composition, wherein said second composition comprises:
  (i) a carrier comprising water and optionally low molecular weight alcohols and polyols, more preferably ethanol, methanol, propanol and mixtures thereof;
  (ii) an effective amount to absorb or reduce malodor, of odor control agent; and
  (iv) an effective amount of a fabric softener;
  wherein said composition has a pH of from about 3 to about 11 and a viscosity of less than about 100 cP;

(d) a second container, wherein said second composition is contained therein;

(e) a set of instructions in association with said first and second containers comprising instruction to identify the apparel characteristics and finish desired of said garment, then treat said garment with whichever of said first or second composition is appropriate for the apparel characteristics and finish desired of said garment.

These and other aspects, features and advantages will become apparent to those of ordinary skill in the art from a reading of the following detailed description and the appended claims. All percentages, ratios and proportions herein are by weight, unless otherwise specified. All temperatures are in degrees Celsius (0° C.) unless otherwise specified. All measurements are in SI units unless otherwise specified. All documents cited are in relevant part, incorporated herein by reference.

DETAILED DESCRIPTION OF THE INVENTION

Definitions:

Garment—the term garment used herein is meant to mean, articles of clothing or the like, such as, hats, socks, pants, skirts, kilts, gloves, coats, shirts, intimate apparel, etc. It also includes these articles made of any material such as, natural fabrics, for example, cotton, wool, silk; man-made fibers, such as, polyester, RAYON, DACRON; blends of fabrics, such as polycotton blends, natural nonfabric materials, for example, leather, suede, rubber; and man made nonfabric materials, for example, PVC, synthetic rubber, imitation leather, "naga" hide etc.

Refreshing, deodorizing, and finishing composition is a composition, which restores garments back to a ready-to-wear or acceptable-to-wear condition. The compositions reduce, mask, and/or remove any malodors, light soils, and/or wrinkles present on or in a garment while simultaneously delivering finishing agents that when added to the material alter the visual, tactile, or behavioral/reactive properties of the garment. These compositions are applied via non-immersive means in the context of the present invention.

Apparel Characteristics—relates to the visual, and tactile properties of a garment as worn. These properties project a personal image of the wearer appropriate to the situation. The image to be conveyed by the wearer will vary depending upon the apparel characteristic of the garment worn. In one circumstance, a wearer will select a garment with apparel characteristics that convey to an observer, formality, while in another select a garment whose apparel characteristics convey, for example, comfort, athleticism and/or sexuality.

Figure 1:
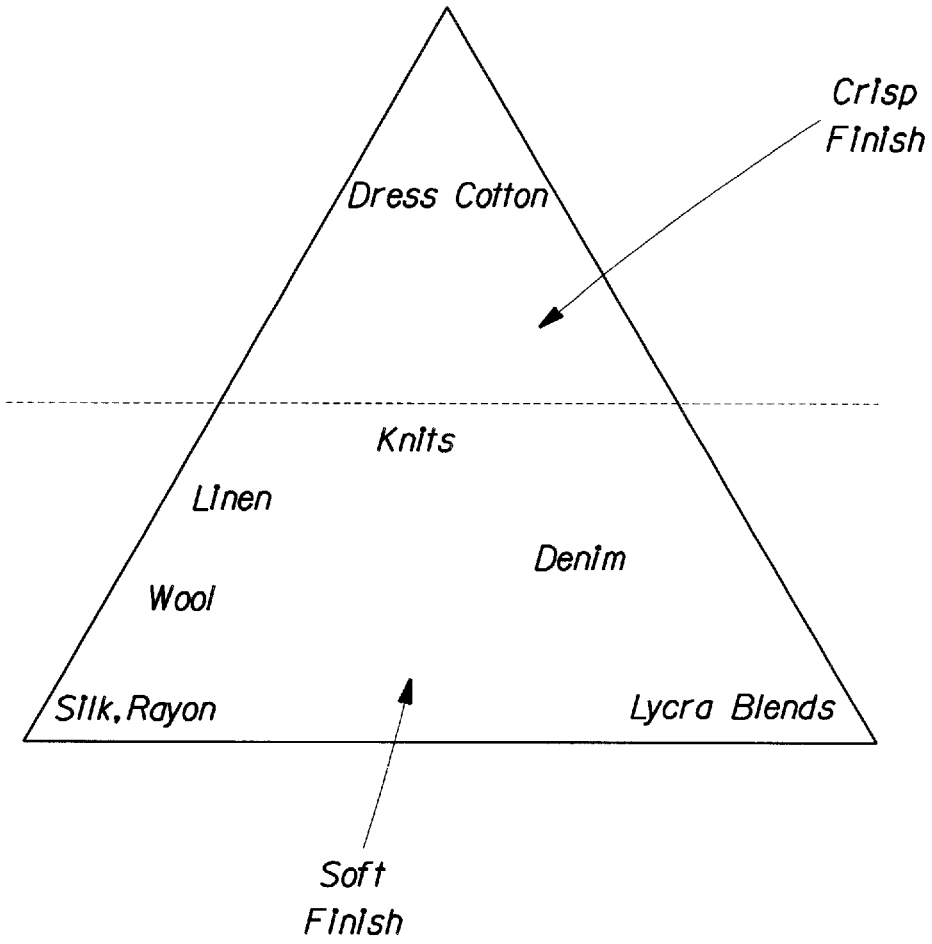
FIG. 1 is a drawing of the Fabric Map, also know as the versioning triangle.
Figure 2A:
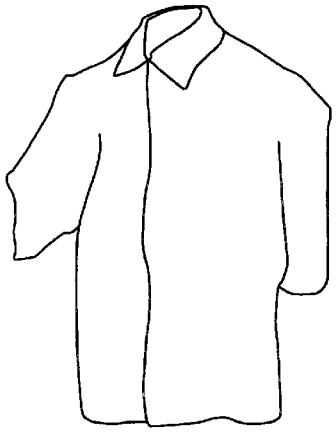
FIG. 2 is an illustration of a typical crisp garment, a typical flow garment and a typical stretch garment.
Figure 2B:
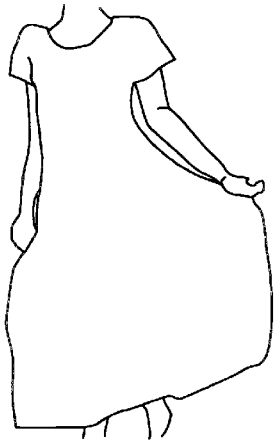
Figure 2C:
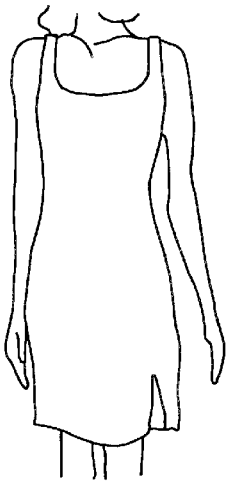

Versioning—is a method for identifying the apparel characteristics of any particular garment. This is based on the type of fabric/material, i.e. wool, cotton, silk, type of weave of material, knit, herringbone, oxford, broadcloth, and the construction of the garment. The combination of these three characteristics allow for a consumer to readily determine, by versioning, the apparel characteristics of any garment. The construction of the garment is further divided in to 3 sub classes as can be seen on the versioning triangle, also known as the fabric map, in FIG. 1. These three subclasses are Crisp, Flow and Stretch, which are explained in greater detail hereinafter. A garment may be totally, a crisp, flow or stretch in construction or it may be some combination of the three. Similarly, how apparel characteristics are identified by versioning will be illustrated in greated detail herein after with reference to the figures.

Crisp—is an apparel characteristic, which is identified by versioning. It defines a garment, which has its own shape and body. A crisp garment tends to resist draping and movement while being worn. Dress business shirts are a good example of a predominately, or totally crisp garment. Figure X shows an illustration of a typical Crisp garment. Other examples of "crisp" garments can be found in FIG. 1.

Flow—is an apparel characteristic that is identified by versioning. It defines a garment that lacks shape and body. A flow garment readily drapes and is unresistant to movement. Kaftans or mumus are good examples of a predominately of totally "flow" garment. Figure X shows an illustration of a typical "flow" garment. Other examples of "flow" garments can be found in FIG. 1.

Stretch—is an apparel characteristic that is identified by versioning. It defines a garment that conforms to the body. A stretch garment contacts and streteches over the consumer's body. A stretch garment stretches and springs back under movement. Bicycle shorts, bating suits, tights, body hugging dresses and stirrup pants are good examples of a predominately or totally stretch garments. Figure X shows an illustration of a typical "stretch" garment. Other examples of "flow" garments can be found in FIG. 1.

Crisp Finish—A crisp finish is a finish designed to give fabric a defined shape that resists gravity, movement, or conformation to the body. This finish is usually applied to business related garments such as men's white cotton dress shirts, giving the impression of being freshly ironed. In essence, this finish provides a defined garment silhouette.

Soft Finish—A soft finish enhances the feel and visional aesthetics of the garment, giving the overall impression of comfort to the garment. For stretch garments, such as lycra blends or knits, soft fabric feel can enhance the fabrics ability to conform and move with the body as well as making fabric to skin contact more comfortable. It also helps provide a revealing silhouette of the body. For flow-type garments, such as silk blouses or rayon dresses, a soft fabric feel can enhance the fabric draping and sliding-over-the-skin characteristics. It also helps provide an undefined silhouette of the body.

This treatment is also acceptable on structured garments such as suits were the structure of the garment provides a defined silhouette, but where flow or stretch characteristics are desired in the fit, or fabric to body contact.

Non-verbal visual cue—is information that assists in identifying the apparel characteristics of a garment. This includes words, symbols and/or pictures that provide information that assists in or determines the apparel characteristics of the garment. Furthermore, the information may be in the form of indicia for visually indicating the suitability or unsuitability of a refreshing, deodorizing and finishing composition for use on a garment. The non-verbal visual clue may be present on the garment as a tag or label. Furthermore any information or instructions present in association with an article of maufacture according to the present invention preferably comprises non-verbal visual cues that assist in assists in identifying the apparel characteristics of a garment. It is further preferred that any such non-verbal visual cues combine with non-verbal visual cues present on a garment to assist in identifying the apparel characteristics of a garment, more preferably assist in identifying the suitability or unsuitability of a refreshing, deodorizing and finishing composition for use on a garment.

Effective amount: The term "effective amount" as used herein means an amount sufficient to produce the desired effect. For example, an effective amount of a refreshing, deodorizing and finishing composition, is an amount sufficient to refresh, deodorize and finish a garment. For wrinkle control, an effective amount means an amount sufficient to remove or noticeably reduce the appearance of wrinkles on fabric. For odor control, an effective amount, as defined herein, means an amount sufficient to absorb odor to effect a noticeable reduction in the perceived odor, preferably to the point that it is not discernible, by the human sense of smell. For static control an effective amount, as defined herein, means and amount sufficient to noticeably reduce voltage on fabrics and cling between fabrics. Preferably, the amount of composition is not so much as to saturate or create a pool of liquid on said article or surface and so that when dry there is no visual deposit readily discernible.

1. Method of Selection and Treatment

When the composition is sprayed onto a garment, an effective amount should be deposited onto the garment, with the garment becoming damp or totally saturated with the composition typically from about 5% to about 150%, preferably from about 10% to about 100%, more preferably from about 20% to about 75%, by weight of the fabric. The amount of polymer active typically sprayed onto the fabric is from about 0.001% to about 2%, preferably from about 0.01% to about 0.5%, more preferably from about 0.02% to about 0.2%, by weight of the garment.

The compositions of the present invention can be sprayed onto garments in an in-home de-wrinkling chamber containing the garment to be refreshed, deodorized and finished, thereby providing ease of operation. Conventional personal as well as industrial apparatuses are suitable for use herein. Traditionally, these apparatuses act by a steaming process that effects a relaxation of the fibers. The spraying of the composition onto the garment can then occur within the chamber of the apparatus or before placing the garment into the chamber. The spraying means should preferably be capable of providing droplets with a weight average diameter of greater than about 8 $\mu$ and preferably greater than about 10 $\mu$m and typically less than about 200 $\mu$m more preferably less than about 150 $\mu$m even more preferably less than about 100 $\mu$m, and most preferably less to about 50 $\mu$m. Preferably, the loading of moisture on garment made of natural and synthetic fibers is typically greater than about 2% more preferably greater than about 5% and typically below about 40%, preferably below about 30% and more preferably below about 25%, and most preferably below about 10% by weight of the dried fabric. Other conventional steps that can be carried out in the dewrinkling apparatus can be applied such as heating and drying. Preferably, for optimum refreshing, deodorizing and finishing benefit, the temperature profile inside the chamber ranges from about 40° C. to about 80° C., more preferably from about 50° C. to about 70° C. The preferred length of the drying cycle is from about 15 to about 60 minutes, more preferably from about 20 to about 45 minutes.

The steaming step in the dewrinkling apparatus can also be eliminated while obtaining the benefits, if the composition is maintained within a temperature range from about 22° C. (about 72° F.) to about 76° C. (about 170° F.) before spraying.

The compositions herein are especially useful, when used to treat garments for extending the time before another wash or dry cleaning cycle is needed. Such garments include uniforms and other garments that are normally treated in an industrial process, which can be refreshed, deodorized and finished and the time between treatments extended.

The presence of the highly preferred surfactant promotes spreading of the solution and the highly preferred antimicrobial active provides improved odor control as well as antimicrobial action, by minimizing the formation of odors. Both the surfactant and the antimicrobial active provide improved performance and the mixture is especially good. When the compositions are applied in the form of the very small particles (droplets), as disclosed hereinbefore, additional benefits are found, since the distribution is even further improved and overall performance is improved.

Garments can be treated with refreshing, deodorizing and finishing compositions in either the dry state or a wet state. For some situations it is preferable to treat garments while those garments are dry. For instance, if the garment is already dry, e.g., if the refreshing, deodorizing and finishing composition will be used to on dry clothes with minor wrinkles that will be worn soon, it is preferable to treat these in the already dry state. A particularly preferred situation involves dry clothing or fabrics that have wrinkles caused by compression, e.g. stored in tight containers (suitcases, trunks), compressed in tight spaces (closets, cabinets), left for some period of time after the end of the drying cycle in an automatic clothes dryer, and/or wrinkled after in-wear conditions. For some situations it may be preferable to treat the garment while they are in the wet state before they are dry.

When dry garments are treated with the refreshing, deodorizing and finishing compositions, the amount of refreshing, deodorizing and finishing composition that should be used is dependent on several factors including, but not limited to, the weight of the garment, and the type of garment. Garments can have several types of wrinkles. One type of is wrinkle is characterized by its relative depth and sharpness. Such wrinkles are difficult to remove and require more of refreshing, deodorizing and finishing compositions and more work by the user to remove. When fabrics have such tough to remove wrinkles or the garment is heavy, refreshing, deodorizing and finishing compositions are typically applied at lower levels of at least about 0.01 times the weight of the garment, preferably at least about 0.1 time the weight of the garment, more preferably at least about 0.25 times the weight of the garment and at higher levels of about 2 times the weight of the garment, more preferably about 1.5 times the weight of the garment, even more preferably about 1 times the weight of the garment and most preferably about 0.75 times the weight of the garment.

Another type of wrinkle is characterized by its broad nature and lack of depth; such wrinkles are often referred to as "bumpiness", "waviness", or "rumples". Such wrinkles are often less difficult to remove than the sharp type of wrinkle discussed above. When garments are lighter in weight or have wrinkles that are less difficult to remove refreshing, deodorizing and finishing compositions are typically applied at lower levels of about 0.001 times the weight of the garment, preferably about 0.01 times the weight of the garment, more preferably about 0.05 times the weight of the garment, even more preferably about 0.1 times the weight of the garment and most preferably about 0.25 times the weight of the garment and at higher levels of about 1.5 times the weight of the garment, preferably about 1 times the weight of the garment, more preferably about 0.75 times the weight of the garment and most preferably about 0.5 times the weight of the garment. To reduce the potential for staining, it is always preferable to minimize the total amount of refreshing, deodorizing and finishing composition needed.

The apparel characteristics of a garment can be readily determined while being worn or while on a hanger. To determine if a garment is a stretch fabric, while on the hanger or while wearing, pull lightly on the edge of the garment. If the garment readily stretches and recovers, then it is a stretch fabric. One suitable type of formula for predominately stretch garments is a soft finish formula is appropriate. Other suitable ones are 2in1 and 3in1 formulas.

If the garment does not stretch, or does not recover, it is either a flow or crisp fabric. To determine which, check the stiffness of the garment. A flow garment will allow have no inherent impedance to movement, while a crisp will impede body movement. In a flow garment, light external forces, such as a breeze, will induce movement. A flow garment will drape over the body, while a crisp garment will resist draping.

These three tests are not restricted in the order of performance and can be performed in any order.

The method of the present invention allow a consumer the freedom to purchase a wider array of garments and fabrics e.g. garments and fabrics which are desirable but typically avoided during purchase decisions due to their tendency to wrinkle. Refreshing, deodorizing and finishing compositions change the care situation of these items from an impractical, time consuming, and frustrating process into a practical task;

thus maximizing the pleasure inherent in owning such items by minimizing the tedium associated with taking care of them.

In a still further aspect of the invention, the composition can be sprayed onto garments by means of an in-home de-wrinkling apparatus containing the fabric to be dewrinkled, thereby providing ease of operation. Conventional personal as well as industrial de-wrinkling apparatus are suitable for use herein. Traditionally, these apparatus act by a steaming process which provides a relaxing of the fibers. The spraying of the composition or compounds on the fabrics can then occurs within the chamber of the apparatus or before placing the fabrics into the chamber. Again, the spraying means should preferably be capable of providing droplets with a mean diameter of from 3 to 50 $\mu$m, preferably from 5–30 $\mu$m for automatic sprayer, and preferably from 50–100 $\mu$m for manually activated sprayer. Preferably, the loading of moisture on fabrics made of natural and synthetic fibers is from 5 to 25%, more preferably from 5 to 10% by weight of the dried fabric. Other conventional steps for the dewrinkling apparatus can be applied such as heating and drying. In one mode of operation, the liquid conditioning composition is fogged by combining it with an air stream under pressure and passed through the atomization nozzle in the cabinet. Preferably, for optimum dewrinkling benefit, the of the air stream and/or the conditioning composition can be heated to enhance distribution and deposition of the conditioning composition on the garments. In that regard, the temperature of the air stream and/or the conditioning composition can be as low as room temperature, and preferably is from 35–80° C., more preferably from 40–70° C. By having the air stream and/or the conditioning composition at the aforementioned elevated temperatures, it has been found that superior de-wrinkling benefits are achieved. It should be understood that the temperature of the conditioning composition can be from about ambient (15° C. ) temperature to about 80° C., and higher temperatures generally improve de-wrinkling performance. The preferred length of the drying cycle is from 20 to 60 minutes, more preferably 30 to 45 minutes.

It has also been found that effective softening composition distribution on the garments, e.g inside the cabinet, can be further enhanced by optimally selecting the fluid surface tension of the softening composition. For example, it is preferable for the softening composition to have fluid surface tension of from about 5 dynes/cm to about 60 dynes/cm, more preferably of from about 10 dynes/cm to about 55 dynes/cm, and most preferably, from about 20 dynes/cm to about 30 dynes/cm. The lower surface tension of the softening composition improves effective distribution by improving surface absorption and spreading of the softening composition on the garment fabric.

2. Composition

The refreshing, deodorizing and finishing compositions useful in the methods of the present invention are preferably essentially free of any material that would soil or stain fabric under usage conditions, or at least do not contain such materials at a level that would soil or stain fabrics unacceptably under usage conditions. The present compositions are preferably applied as small droplets to garments.

The following describes the preferred ingredients, including optional ingredients, of the refreshing, deodorizing and finishing compositions useful in the present invention in further detail.

Highly Preferred Ingredients:

Carrier

The preferred carrier of the present invention is water. The water which is used can be distilled, deionized, or tap water. Water is the preferred main liquid carrier due to its low cost, availability, safety, and environmental compatibility.

Water is very useful for fabric wrinkle removal or reduction. It is believed that water breaks many intrafiber and interfiber hydrogen bonds that keep the fabric in a wrinkle state. It also swells, lubricates and relaxes the fibers to help the wrinkle removal process.

Water also serves as the liquid carrier for the optional cyclodextrins, and facilitates the complexation reaction between the cyclodextrin molecules and any malodorous molecules that are on the fabric when it is treated. The dilute aqueous solution also provides the maximum separation of cyclodextrin molecules on the fabric and thereby maximizes the chance that an odor molecule will interact with a cyclodextrin molecule. It has also been discovered that water has an unexpected odor controlling effect of its own. It has been discovered that the intensity of the odor generated by some polar, low molecular weight organic amines, acids, and mercaptans is reduced when the odor-contaminated fabrics are treated with an aqueous solution. It is believed that water solubilizes and depresses the vapor pressure of these polar, low molecular weight organic molecules, thus reducing their odor intensity.

Water is inexpensive and effective at breaking hydrogen bonds and polymers are effective at helping to lubricate fibers, but especially at holding fibers and garments in place once the desired smoothness is achieved to retain the smoothness. Refreshing, deodorizing and finishing compositions disclosed within are typically applied to garments by spraying within some type of mechanical chamber (e.g. cabinet) for altering the properties of fabrics. Therefore to prevent garment staining, it is important to have a refreshing, deodorizing and finishing composition that mists or aerosolizes rather than streaming.

The level of liquid carrier in the compositions of the present invention is typically greater than about 70%, preferably greater than about 90%, and more preferably greater than about 92%, by weight of the composition. When a concentrated composition is used, the level of liquid carrier is typically equal to or below about 90%, by weight of the composition, preferably equal to or below about about 70%, more preferably equal to or below about 50%, even more preferably equal to or below about 30% by weight of the concentrated composition.

In addition to water, the carrier can further comprise solvents and plasticizers act to aid the natural ability of water to plasticize fibers. Acceptable solvents and plasticizers include compounds having from one to ten carbons. The following non-limiting classes of compounds are suitable: mono-alcohols, diols, polyhydric alcohols, ethers, ketones, esters, organic acids, and alkyl glyceryl ethers, and hydrocarbons. Preferred solvents are soluble in water and/or miscible in the presence of optional surfactant. Some non-limiting examples include methanol, ethanol, isopropanol, hexanol, 1,2-hexanediol, hexylene glycol, (e.g. 2-methyl-2,4-pentanediol), isopropylen glycol (3-methyl-1,3-butanediol), 1,2-butylene glycol, 2,3-butylene glycol, 1,3-butylene glycol, 1,4-butylene glycol, 1,3-propylene glycol, 1,2-propylene glycol, isomers of cyclohexanedimethanol, isomers of propanediol, isomers of butanediol, the isomers of trimethylpentanediol, the isomers of ethylmethylpentanediol, alcohol ethoxylates of 2-ethyl-1,3-hexanediol, 2,2,4-trimethyl-1,3-pentanediol, alcohol ethoxylates of 2,2,4-trimethyl-1,3-pentanediol glycerol, ethylene glycol, diethylene glycol, dipropylene glycol, sorbitol, 3-methyl-3-methoxybutanol, 3-methoxybutanol, 1-ethoxy-2-propanol, diethylene glycol monoethyl ether, diethylene glycol monopropyl ether, diethylene glycol monobutyl ether, triethylene glycol monoethyl ether, erythritol, and mixtures of solvents and plasticizers. When optional cyclodextrin is present, the plasticizer should be compatible with it. Mixtures of solvents are also suitable. When solvent is used, it is used typically at a level of at least about 0.5%, preferably at least about 1%, more preferably at least about 2%, even more preferably at least about 3% and still more preferably at least about 4% and typically less than about 30%, preferably less than about 25%, more preferably less than about 20%, even more preferably less than about 15% by weight of the composition.

Odor Control Agent—The compositions for odor control are of the type disclosed in U.S. Pat. Nos. 5,534,165; 5,578,563; 5,663,134; 5,668,097; 5,670,475; and 5,714,137, Trinh et al. issued Jul. 9, 1996; Nov. 26, 1996; Sep. 2, 1997; Sep. 16, 1997; Sep. 23, 1997; and Feb. 3, 1998 respectively, all of said patents being incorporated herein by reference. Such compositions can contain several different optional odor control agents in addition to the polymers described hereinbefore that can control amine odors.

Cyclodextrin—As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on wet fabrics. As the water is being removed however, e.g., the fabric is being dried off, some low molecular weight organic amines and acids have more affinity and will complex with the cyclodextrins more readily.

While not wanting to be limited by theory, it is believed that in solution the cavities within the cyclodextrin remain essentially unfilled (the cyclodextrin remains uncomplexed) while in solution, in order to allow the cyclodextrin to absorb various odor molecules when the solution is applied to a surface. Non-derivatised (normal) beta-cyclodextrin can be present at a level up to its solubility limit of about 1.85% (about 1.85 g in 100 grams of water) at room temperature. Beta-cyclodextrin is not preferred in compositions which call for a level of cyclodextrin higher than its water solubility limit. Non-derivatised beta-cyclodextrin is generally not preferred when the composition contains surfactant since it affects the surface activity of most of the preferred surfactants that are compatible with the derivatised cyclodextrins.

Preferably, the cyclodextrins used in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $—CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio) propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. No. 3,426,011, Parmerter et al., issued Feb. 4, 1969; U.S. Pat. Nos. 3,453,257; 3,453,258; 3,453,259; and 3,453,260, all in the names of Parmerter et al., and all issued July 1, 1969; U.S. Pat. No. 3,459,731, Gramera et al., issued Aug. 5, 1969; U.S. Pat. No. 3,553,191, Parmerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; U.S. Pat. No. 4,678,598, Ogino et al., issued Jul. 7, 1987; U.S. Pat. No. 4,638,058, Brandt et al., issued Jan. 20, 1987; and U.S. Pat. No. 4,746,734, Tsuchiyama et al., issued May 24, 1988; all of said patents being incorporated herein by reference.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. Solubilized, water-soluble cyclodextrin can exhibit more efficient odor control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrins is alpha-cyclodextrin and its derivatives thereof, gamma-cyclodextrin and its derivatives thereof, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

Preferably, the solution used to treat the surface under usage conditions is virtually not discernible when dry. Typical levels of cyclodextrin, when present, in usage compositions for usage conditions are from about 0.01% to about 5%, preferably from about 0.1% to about 4%, more preferably from about 0.5% to about 2% by weight of the composition. Compositions with higher concentrations can leave unacceptable visible stains on fabrics as the solution evaporates off of the fabric. This is especially a problem on thin, colored, synthetic fabrics. In order to avoid or minimize the occurrence of fabric staining, it is preferable that the fabric be treated at a level of less than about 5 mg of cyclodextrin per gram of fabric, more preferably less than about 2 mg of cyclodextrin per gram of fabric. The presence of the surfactant can improve appearance by minimizing localized spotting.

When it is desired to incorporate cyclodextrin into a concentrated product, the cyclodextrin level is typically from about 3% to about 20%, more preferably from about 5% to about 10%, by weight of the concentrated composition, it is preferable to dilute the concentrated composition before treating fabrics in order to avoid staining. The resulting diluted compostion have usage concentrations of cyclodextrin as discussed hereinbefore, e.g., of from about 0.1% to about 5%, by weight of the diluted composition.

Surfactant

The surfactant, provides a low surface tension that permits the composition to spread readily and more uniformly on hydrophobic surfaces. It has been found that the aqueous solution, without such a surfactant will not spread satisfactorily. The spreading of the composition also allows it to dry faster, so that the treated material is ready to use sooner. Furthermore, the composition containing a surfactant can penetrate hydrophobic, oily soil better for improved malodor control. The composition containing a cyclodextrin-compatible surfactant also provides improved "in-wear" electrostatic control. For concentrated compositions, the surfactant facilitates the dispersion of many actives such as antimicrobial actives and perfumes in the concentrated aqueous compositions.

The surfactant is also needed in the composition of the present invention that contains a wrinkle control agent such as silicone and/or shape retention polymer. For such agents, the surfactant is also needed, e.g., as a dispersing agent, an emulsifying agent and/or a solubilizing agent.

The surfactant for use in providing the required low surface tension in the composition of the present invention should be cyclodextrin-compatible, that is it should not substantially form a complex with the cyclodextrin so as to diminish performance of the cyclodextrin and/or the surfactant. Complex formation diminishes both the ability of the cyclodextrin to absorb odors and the ability of the surfactant to lower the surface tension of the aqueous composition.

Suitable surfactants, especially cyclodextrin-compatible surfactants, can be readily identified by the absence of effect of cyclodextrin on the surface tension provided by the surfactant. This is achieved by determining the surface tension (in dyne/cm$^2$) of aqueous solutions of the surfactant in the presence and in the absence of about 1% of a specific cyclodextrin in the solutions. The aqueous solutions contain surfactant at concentrations of approximately 0.5%, 0.1%, 0.01%, and 0.005%. The cyclodextrin can affect the surface activity of a surfactant by elevating the surface tension of the surfactant solution. If the surface tension at a given concentration in water differs by more than about 10% from the surface tension of the same surfactant in the 1% solution of the cyclodextrin, that is an indication of a strong interaction between the surfactant and the cyclodextrin. The preferred surfactants herein should have a surface tension in an aqueous solution that is different (lower) by less than about 10%, preferably less than about 5%, and more preferably less than about 1% from that of the same concentration solution containing 1% cyclodextrin.

Nonlimiting examples of cyclodextrin-compatible nonionic surfactants include block copolymers of ethylene oxide and propylene oxide. Suitable block polyoxyethylene-polyoxypropylene polymeric surfactants, that are compatible with most cyclodextrins, include those based on ethylene glycol, propylene glycol, glycerol, trimethylolpropane and ethylenediamine as the initial reactive hydrogen compound. Polymeric compounds made from a sequential ethoxylation and propoxylation of initial compounds with a single reactive hydrogen atom, such as $C_{12-18}$ aliphatic alcohols, are not generally compatible with the cyclodextrin. Certain of the block polymer surfactant compounds designated Pluronic® and Tetronic® by the BASF-Wyandotte Corp., Wyandotte, Mich., are readily available.

Nonlimiting examples of cyclodextrin-compatible surfactants of this type include:

Pluronic Surfactants with the general formula $$H(EO)_n(PO)_m(EO)_nH,$$

wherein EO is an ethylene oxide group, PO is a propylene oxide group, and n and m are numbers that indicate the average number of the groups in the surfactants. Typical examples of cyclodextrin-compatible Pluronic surfactants are:

| Name | Average MW | Average n | Average m |
|---|---|---|---|
| L-101 | 3,800 | 4 | 59 |
| L-81 | 2,750 | 3 | 42 |

-continued

| Name | Average MW | Average n | Average m |
|---|---|---|---|
| L-44 | 2,200 | 10 | 23 |
| L-43 | 1,850 | 6 | 22 |
| F-38 | 4,700 | 43 | 16 |
| P-84 | 4,200 | 19 | 43, |

and mixtures thereof.

Tetronic Surfactants with the general formula:

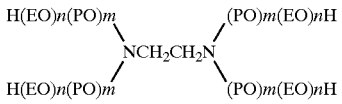

wherein EO, PO, n, and m have the same meanings as above. Typical examples of cyclodextrin-compatible Tetronic surfactants are:

| Name | Average MW | Average n | Average m |
|---|---|---|---|
| 901 | 4,700 | 3 | 18 |
| 908 | 25,000 | 114 | 22, |

and mixtures thereof.

"Reverse" Pluronic and Tetronic surfactants have the following general formulas:

Reverse Pluronic Surfactants

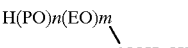

Reverse Tetronic Surfactants

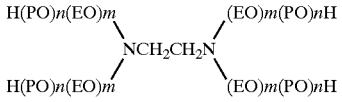

wherein EO, PO, n, and m have the same meanings as above. Typical examples of cyclodextrin-compatible Reverse Pluronic and Reverse Tetronic surfactants are:

Reverse Pluronic surfactants:

| Name | Average MW | Average n | Average m |
|---|---|---|---|
| 10 R5 | 1,950 | 8 | 22 |
| 25 R1 | 2,700 | 21 | 6 |

Reverse Tetronic surfactants

| Name | Average MW | Average n | Average m |
|---|---|---|---|
| 130 R2 | 7,740 | 9 | 26 |
| 70 R2 | 3,870 | 4 | 13 |

and mixtures thereof.

A preferred class of cyclodextrin-compatible nonionic surfactants are the polyalkylene oxide polysiloxanes having a dimethyl polysiloxane hydrophobic moiety and one or more hydrophilic polyalkylene side chains, and having the general formula:

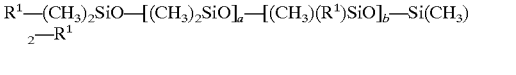

wherein a+b are from about 1 to about 50, preferably from about 3 to about 30 , more preferably from about 10 to about 25, and each $R^1$ is the same or different and is selected from the group consisting of methyl and a poly(ethyleneoxide/propyleneoxide) copolymer group having the general formula:

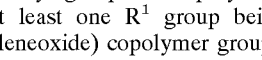

with at least one $R^1$ being a poly(ethyleneoxide/propyleneoxide) copolymer group, and wherein n is 3 or 4, preferably 3; total c (for all polyalkyleneoxy side groups) has a value of from 1 to about 100, preferably from about 6 to about 100; total d is from 0 to about 14, preferably from 0 to about 3; and more preferably d is 0; total c+d has a value of from about 5 to about 150, preferably from about 9 to about 100 and each $R^2$ is the same or different and is selected from the group consisting of hydrogen, an alkyl having 1 to 4 carbon atoms, and an acetyl group, preferably hydrogen and methyl group. Each polyalkylene oxide polysiloxane has at least one $R^1$ group being a poly(ethyleneoxide/propyleneoxide) copolymer group.

Nonlimiting examples of this type of surfactants are the Silwet® surfactants which are available OSi Specialties, Inc., Danbury, Conn. Representative Silwet surfactants are as follows.

| Name | Average MW | Average a + b | Average total c |
|---|---|---|---|
| L-7608 | 600 | 1 | 9 |
| L-7607 | 1,000 | 2 | 17 |
| L-77 | 600 | 1 | 9 |
| L-7605 | 6,000 | 20 | 99 |
| L-7604 | 4,000 | 21 | 53 |
| L-7600 | 4,000 | 11 | 68 |
| L-7657 | 5,000 | 20 | 76 |
| L-7602 | 3,000 | 20 | 29 |

The molecular weight of the polyalkyleneoxy group ($R^1$) is less than or equal to about 10,000. Preferably, the molecular weight of the polyalkyleneoxy group is less than or equal to about 8,000, and most preferably ranges from about 300 to about 5,000. Thus, the values of c and d can be those numbers which provide molecular weights within these ranges. However, the number of ethyleneoxy units ($—C_2H_4O$) in the polyether chain ($R^1$) must be sufficient to render the polyalkylene oxide polysiloxane water dispersible or water soluble. If propyleneoxy groups are present in the polyalkylenoxy chain, they can be distributed randomly in the chain or exist as blocks. Preferred Silwet surfactants are L-7600, L-7602, L-7604, L-7605, L-7622, L-7657, and mixtures thereof. Besides surface activity, polyalkylene oxide polysiloxane surfactants can also provide other benefits, such as antistatic benefits, lubricity and softness to fabrics.

The preparation of polyalkylene oxide polysiloxanes is well known in the art. Polyalkylene oxide polysiloxanes of the present invention can be prepared according to the procedure set forth in U.S. Pat. No. 3,299,112, incorporated herein by reference. Typically, polyalkylene oxide polysiloxanes of the surfactant blend of the present invention are readily prepared by an addition reaction between a hydrosiloxane (i.e., a siloxane containing silicon-bonded hydrogen) and an alkenyl ether (e.g., a vinyl, allyl, or methallyl ether) of an alkoxy or hydroxy end-blocked polyalkylene oxide). The reaction conditions employed in addition reactions of this type are well known in the art and in general involve heating the reactants (e.g., at a temperature of from about 85° C. to 110° C.) in the presence of a platinum catalyst (e.g., chloroplatinic acid) and a solvent (e.g., toluene).

Nonlimiting examples of cyclodextrin-compatible anionic surfactants are the alkyldiphenyl oxide disulfonate, having the general formula:

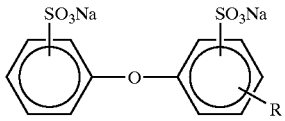

wherein R is an alkyl group. Examples of this type of surfactants are available from the Dow Chemical Company under the trade name Dowfax® wherein R is a linear or branched $C_6$–$C_{16}$ alkyl group. An example of these cyclodextrin-compatible anionic surfactant is Dowfax 3B2 with R being approximately a linear $C_{10}$ group. These anionic surfactants are preferably not used when the antimicrobial active or preservative, etc., is cationic to minimize the interaction with the cationic actives, since the effect of both surfactant and active are diminished.

Another type of suitable surfactants are the fluorocarbon surfactants. Fluorocarbon surfactants are the class of surfactants wherein the hydrophobic part of the amphiphile comprises at least in part some portion of a carbon-based linear or cyclic moiety having fluorines attached to the carbon where typically hydrogens would be attached to the carbons together with a hydrophilic head group. Some typical nonlimiting fluorocarbon surfactants include fluorinated alkyl polyoxyalkylene, and fluorinated alkyl esters as well as ionic surfactants. Representative structures for these compounds are given below:

$$R_fR(R_1O)_xR_2 \quad (1)$$

$$R_fR—OC(O)R_3 \quad (2)$$

$$R_fR—Y—Z \quad (3)$$

$$R_fRZ \quad (4)$$

Where Rf contains from about 6 to about 18 carbons each having from about 0 to about 3 fluorines attached. R is either an alkyl or alkylene oxide group which when present, has from about 1 to about 10 carbons and R1 represents an alkylene radical having from about 1 to about 4 carbons, R2 is either a hydrogen or a small alkyl capping group having from about 1 to about 3 carbons. R3 represents a hydrocarbon moiety comprising from about 2 to about 22 including the carbon on the ester group. This hydrocarbon can be linear, branched or cyclic saturated or unsaturated and contained moieties based on oxygen, nitrogen, and sulfur including, but not limited to ethers, alcohols, esters, carboxylates, amides, amines, thio-esters, and thiols; these oxygen, nitrogen, and sulfur moieties can either interrupt the hydrocabon chain or be pendant on the hydrocarbon chain. In structure 3, Y represents a hydrocarbon group that can be an alkyl, pyridine group, amidopropyl, etc. that acts as a linking group between the fluorinated chain and the hydrophilic head group. In structures 3 and 4, Z represents a cationic, anionic, and amphoteric hydrophilic head groups including, but not limited to carboxylates, sulfates, sulfonates, quaternary ammonium groups, and betaines. Nonlimiting commercially available examples of these structures include Zonyl® 9075, FSO, FSN, FS-300, FS-310, FSN-100, FSO-100, FTS, TBC from DuPont and Fluorad™ surfactants FC-430, FC-431, FC-740, FC-99, FC-120, FC-754, FC170C, and FC-171 from the 3M™ company in St. Paul, Minn.

The surfactants above are either weakly interactive with cyclodextrin (less than 5% elevation in surface tension, or non-interactive (less than 1% elevation in surface tension). Normal surfactants like sodium dodecyl sulfate and dodecanolpoly(6)ethoxylate are strongly interactive, with more than a 10% elevation in surface tension in the presence of a typical cyclodextrin like hydroxypropyl-beta-cyclodextrin and methylated beta-cyclodextrin.

Typical levels of surfactants in usage compositions are from about 0.01% to about 2%, preferably from about 0.03% to about 0.6%, more preferably from about 0.05% to about 0.3%, by weight of the composition. Typical levels of surfactants in concentrated compositions are from about 0.1% to about 8%, preferably from about 0.2% to about 4%, more preferably from about 0.3% to about 3%, by weight of the concentrated composition. For composition containing wrinkle control agent, typical levels of surfactants in the usage compositions are from about 0.05% to about 5%, preferably from about 0.1% to about 3%, more preferably from about 0.2% to about 1.5%, by weight of the composition.

Antimicrobial Active

The solubilized, water-soluble antimicrobial active, C., is useful in providing protection against organisms that become attached to the treated material. Preferably, the antimicrobial should be cyclodextrin-compatible, e.g., not substantially forming complexes with the cyclodextrin in the odor absorbing composition. The free, uncomplexed antimicrobial, e.g., antibacterial, active provides an optimum antibacterial performance.

Sanitization of ballistic fabrics can be achieved by the compositions of the present invention containing, antimicrobial materials, e.g., antibacterial halogenated compounds, quaternary compounds, and phenolic compounds.

Biguanides.

Some of the more robust cyclodextrin-compatible antimicrobial halogenated compounds which can function as disinfectants/sanitizers as well as finish product preservatives (vide infra), and are useful in the compositions of the present invention include 1,1'-hexamethylene bis(5-(p-chlorophenyl)biguanide), commonly known as chlorhexidine, and its salts, e.g., with hydrochloric, acetic and gluconic acids. The digluconate salt is highly water-soluble, about 70% in water, and the diacetate salt has a solubility of about 1.8% in water. When chlorhexidine is used as a sanitizer in the present invention it is typically present at a level of from about 0.001% to about 0.4%, preferably from about 0.002% to about 0.3%, and more preferably from about 0.05% to about 0.2%, by weight of the usage composition. In some cases, a level of from about 1% to about 2% may be needed for virucidal activity.

Other useful biguanide compounds include Cosmoci® CQ®, Vantocil® IB, including poly (hexamethylene biguanide) hydrochloride. Other useful cationic antimicrobial agents include the bis-biguanide alkanes. Usable water soluble salts of the above are chlorides, bromides, sulfates, alkyl sulfonates such as methyl sulfonate and ethyl sulfonate, phenylsulfonates such as p-methylphenyl sulfonates, nitrates, acetates, gluconates, and the like.

Examples of suitable bis biguanide compounds are chlorhexidine; 1,6-bis-(2-ethylhexylbiguanidohexane) dihydrochloride; 1,6-di-($N_1$,$N_1$'-phenyldiguanido-$N_5$,$N_5$')-hexane tetrahydrochloride; 1,6-di-($N_1$,$N_1$'-phenyl-$N_1$,$N_1$'-methyldiguanido-$N_5$,$N_5$')-hexane dihydrochloride; 1,6-di ($N_1$,$N_1$'-o-chlorophenyldiguanido-$N_5$,$N_5$')-hexane dihydrochloride; 1,6-di($N_1$,$N^1$'-2,6-dichlorophenyldiguanido-$N_5$,$N_5$')hexane dihydrochloride; 1,6-di[$N_1$,$N_1$'-.beta.-(p-methoxyphenyl) diguanido-$N_5$,$N_5$']-hexane dihydrochloride; 1,6-di($N_1$,$N_1$'-.alpha.-methyl-.beta.-phenyldiguanido-$N_5$,$N_5$')-hexane dihydrochloride; 1,6-di($N_1$,$N_1$'-p-nitrophenyldiguanido-$N_5$,$N_5$')hexane dihydrochloride; .omega.:.omega.'-di-($N_1$,$N_1$'-phenyldiguanido-$N_5$,$N_5$')-di-n-propylether dihydrochloride; .omega:omega'-di($N_1$,$N_1$'-p-chlorophenyldiguanido-$N_5$,$N_5$')-di-n-propylether tetrahydrochloride; 1,6-di($N_1$,$N_1$'-2,4-dichlorophenyldiguanido-$N_5$,$N_5$')hexane tetrahydrochloride; 1,6-di($N_1$,$N_1$'-p-methylphenyldiguanido-$N_5$,$N_5$')hexane dihydrochloride; 1,6-di($N_1$,$N_1$'-2,4,5-trichlorophenyldiguanido-$N_5$,$N_5$') hexane tetrahydrochloride; 1,6-di[$N_1$,$N_1$'-.alpha.-(p-chlorophenyl) ethyldiguanido-$N_5$,$N_5$'] hexane dihydrochloride;.omega.:.omega.'di($N_1$,$N_1$'-p-chlorophenyldiguanido-$N_5$,$N_5$')m-xylene dihydrochloride; 1,12-di($N_1$,$N_1$'-p-chlorophenyldiguanido-$N_5$,$N_5$')dodecane dihydrochloride; 1,10-di($N_1$,$N_1$'-phenyldiguanido-$N_5$,$N_5$')-decane tetrahydrochloride; 1,12-di($N_1$,$N_1$'-phenyldiguanido-$N_5$,$N_5$') dodecane tetrahydrochloride; 1,6-di($N_1$,$N_1$'-o-chlorophenyldiguanido-$N_5$,$N_5$') hexane dihydrochloride; 1,6-di($N_1$,$N_1$'-p-chlorophenyldiguanido-$N_5$,$N_5$')-hexane tetrahydrochloride; ethylene bis (1-tolyl biguanide); ethylene bis (p-tolyl biguanide); ethylene bis(3,5-dimethylphenyl biguanide); ethylene bis(p-tert-amylphenyl biguanide); ethylene bis(nonylphenyl biguanide); ethylene bis (phenyl biguanide); ethylene bis (N-butylphenyl biguanide); ethylene bis (2,5-diethoxyphenyl biguanide); ethylene bis(2,4-dimethylphenyl biguanide); ethylene bis(o-diphenylbiguanide); ethylene bis(mixed amyl naphthyl biguanide); N-butyl ethylene bis(phenylbiguanide); trimethylene bis(o-tolyl biguanide); N-butyl trimethylene bis (phenyl biguanide); and the corresponding pharmaceutically acceptable salts of all of the above such as the acetates; gluconates; hydrochlorides; hydrobromides; citrates; bisulfites; fluorides; polymaleates; N-coconutalkylsarcosinates; phosphites; hypophosphites; perfluorooctanoates; silicates; sorbates; salicylates; maleates; tartrates; fumarates; ethylenediaminetetraacetates; iminodiacetates; cinnamates; thiocyanates; arginates; pyromellitates; tetracarboxybutyrates; benzoates; glutarates; monofluorophosphates; and perfluoropropionates, and mixtures thereof. Preferred antimicrobials from this group are 1,6-di-($N_1$,$N_1$'-phenyldiguanido-$N_5$,$N_5$')-hexane tetrahydrochloride; 1,6-di($N_1$,$N_1$'-o-chlorophenyldiguanido-$N_5$,$N_5$')-hexane dihydrochloride; 1,6-di($N_1$,$N_1$'-2,6-dichlorophenyldiguanido-$N_5$,$N_5$')hexane dihydrochloride; 1,6-di($N_1$,$N_1$'-2,4-dichlorophenyldiguanido-$N_5$,$N_5$')hexane tetrahydrochloride; 1,6-di[$N_1$,$N_1$'-.alpha.-(p-chlorophenyl) ethyldiguanido-$N_5$,$N_5$'] hexane dihydrochloride;.omega.:.omega.'di($N_1$, $N_1$'-p-chlorophenyldiguanido-$N_5$,$N_5$')m-xylene dihydrochloride; 1,12-di($N_1$,$N_1$'-p-chlorophenyldiguanido-$N_5$,$N_5$,$N_5$') dodecane dihydrochloride; 1,6-di($N_1$,$N_1$'-o-chlorophenyldiguanido-$N_5$,$N_5$') hexane dihydrochloride; 1,6-di($N_1$,$N_1$'-p-chlorophenyldiguanido-$N_5$,$N_5$')-hexane tetrahydrochloride; and mixtures thereof; more preferably, 1,6-di($N_1$,$N_1$'-o-chlorophenyldiguanido-$N_5$,$N_5$')-hexane dihydrochloride; 1,6-di($N_1$,$N_1$'-2,6-dichlorophenyldiguanido-$N_5$,$N_5$')hexane dihydrochloride; 1,6-di($N_1$,$N_1$'-2,4-dichlorophenyldiguanido-$N_5$,$N_5$')hexane tetrahydrochloride; 1,6-di[$N_1$,$N_1$'-.alpha.-(p-chlorophenyl) ethyldiguanido-$N_5$,$N_5$'] hexane dihydrochloride; .omega.:.omega.'di($N_1$,$N_1$'-p-chlorophenyldiguanido-$N_5$,$N_5$')m-xylene dihydrochloride; 1,12-di($N_1$,$N_1$'-p-chlorophenyldiguanido-$N_5$,$N_5$') dodecane dihydrochloride; 1,6-di($N_1$,$N_1$'-o-chlorophenyldiguanido-$N_5$,$N_5$') hexane dihydrochloride; 1,6-di($N_1$,$N_1$'-p-chlorophenyldiguanido-$N_5$,$N_5$')-hexane tetrahydrochloride; and mixtures thereof. As stated hereinbefore, the bis biguanide of choice is chlorhexidine its salts, e.g., digluconate, dihydrochloride, diacetate, and mixtures thereof.

Quaternary Compounds.

A wide range of quaternary compounds can also be used as antimicrobial actives. Non-limiting examples of useful quaternary compounds include: (1) benzalkonium chlorides and/or substituted benzalkonium chlorides such as commercially available Barquat® (available from Lonza), Maquat® (available from Mason), Variquat® (available from Witco/Sherex), and Hyamine® (available from Lonza); (2) di($C_6$–$C_{14}$)alkyl di short chain ($C_{1-4}$ alkyl and/or hydroxyalkyl) quaternary such as Bardac® products of Lonza, (3) N-(3-chloroallyl) hexaminium chlorides such as Dowicide® and Dowicil® available from Dow; (4) benzethonium chloride such as Hyamine® 1622 from Rohm & Haas; (5) methylbenzethonium chloride represented by Hyamine® 10X supplied by Rohm & Haas, (6) cetylpyridinium chloride such as Cepacol chloride available from of Merrell Labs. Examples of the preferred dialkyl quaternary compounds are di($C_8$–$C_{12}$)dialkyl dimethyl ammonium chloride, such as didecyldimethylammonium chloride (Bardac 22), and dioctyldimethylammonium chloride (Bardac 2050). Typical concentrations for biocidal effectiveness of these quaternary compounds range from about 0.001% to about 0.8%, preferably from about 0.005% to about 0.3%, more preferably from about 0.01% to about 0.2%, and even more preferably from about 0.03% to about 0.1%, by weight of the usage composition. The corresponding concentrations for the concentrated compositions are from about 0.003% to about 2%, preferably from about 0.006% to about 1.2%, and more preferably from about 0.1% to about 0.8% by weight of the concentrated compositions.

The surfactants, when added to the antimicrobials tend to provide improved antimicrobial action. This is especially true for the siloxane surfactants, and especially when the siloxane surfactants are combined with the chlorhexidine antimicrobial actives.

Perfume

The odor absorbing composition of the present invention can also optionally provide a "scent signal" in the form of a pleasant odor which signals the removal of malodor from fabrics. The scent signal is designed to provide a fleeting perfume scent, and is not designed to be overwhelming or to be used as an odor masking ingredient. When perfume is added as a scent signal, it is added only at very low levels, e.g., from about 0% to about 0.5%, preferably from about 0.003% to about 0.3%, more preferably from about 0.005% to about 0.2%, by weight of the usage composition.

Perfume can also be added as a more intense odor in product and on surfaces. When stronger levels of perfume are preferred, relatively higher levels of perfume can be added. Any type of perfume can be incorporated into the composition of the present invention. It is essential, however, that the perfume be added at a level wherein even if all of the perfume in the composition were to complex with the cyclodextrin molecules, there will still be an effective level of uncomplexed cyclodextrin molecules present in the solution to provide adequate odor control. In order to reserve an effective amount of cyclodextrin molecules for odor control, perfume is typically present at a level wherein less than about 90% of the cyclodextrin complexes with the perfume, preferably less than about 50% of the cyclodextrin complexes with the perfume, more preferably, less than about 30% of the cyclodextrin complexes with the perfume, and most preferably, less than about 10% of the cyclodextrin complexes with the perfume. The cyclodextrin to perfume weight ratio should be greater than about 8:1, preferably greater than about 10:1, more preferably greater than about 20:1, even more preferably greater than 40:1 and most preferably greater than about 70:1.

Preferably the perfume is hydrophilic and is composed predominantly of ingredients selected from two groups of ingredients, namely, (a) hydrophilic ingredients having a ClogP of less than about 3.5, more preferably less than about 3.0, and (b) ingredients having significant low detection threshold, and mixtures thereof. Typically, at least about 50%, preferably at least about 60%, more preferably at least about 70%, and most preferably at least about 80% by weight of the perfume is composed of perfume ingredients of the above groups (a) and (b). For these preferred perfumes, the cyclodextrin to perfume weight ratio is typically of from about 2:1 to about 200:1; preferably from about 4:1 to about 100:1, more preferably from about 6:1 to about 50:1, and even more preferably from about 8:1 to about 30:1.

(a). Hydrophilic Perfume Ingredients

The hydrophilic perfume ingredients are more soluble in water, have less of a tendency to complex with cyclodextrin, and are more available in the odor absorbing composition than the ingredients of conventional perfumes. The degree of hydrophobicity of a perfume ingredient can be correlated with its octanol/water partition coefficient P. The octanol/water partition coefficient of a perfume ingredient is the ratio between its equilibrium concentration in octanol and in water. A perfume ingredient with a greater partition coefficient P is considered to be more hydrophobic. Conversely, a perfume ingredient with a smaller partition coefficient P is considered to be more hydrophilic. Since the partition coefficients of the perfume ingredients normally have high values, they are more conveniently given in the form of their logarithm to the base 10, logP. Thus the preferred perfume hydrophilic perfume ingredients of this invention have logP of about 3.5 or smaller, preferably of about 3.0 or smaller.

The logP of many perfume ingredients have been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logp" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are used instead of the experimental logP values in the selection of perfume ingredients which are useful in the present invention.

Non-limiting examples of the more preferred hydrophilic perfume ingredients are allyl amyl glycolate, allyl caproate, amyl acetate, amyl propionate, anisic aldehyde, anisyl acetate, anisole, benzaldehyde, benzyl acetate, benzyl acetone, benzyl alcohol, benzyl formate, benzyl iso valerate, benzyl propionate, beta gamma hexenol, calone, camphor gum, laevo-carveol, d-carvone, laevo-carvone, cinnamic alcohol, cinnamyl acetate, cinnamic alcohol, cinnamyl formate, cinnamyl propionate, cis-jasmone, cis-3-hexenyl acetate, coumarin, cuminic alcohol, cuminic aldehyde, Cyclal C, cyclogalbanate, dihydroeuginol, dihydro isojasmonate, dimethyl benzyl carbinol, dimethyl benzyl carbinyl acetate, ethyl acetate, ethyl aceto acetate, ethyl amyl ketone, ethyl anthranilate, ethyl benzoate, ethyl butyrate, ethyl cinnamate, ethyl hexyl ketone, ethyl maltol, ethyl-2-methyl butyrate, ethyl methylphenyl glycidate, ethyl phenyl acetate, ethyl salicylate, ethyl vanillin, eucalyptol, eugenol, eugenyl acetate, eugenyl formate, eugenyl methyl ether, fenchyl alcohol, flor acetate (tricyclo decenyl acetate), fructone, frutene (tricyclo decenyl propionate), geraniol, geranyl oxyacetaldehyde, heliotropin, hexenol, hexenyl acetate, hexyl acetate, hexyl formate, hinokitiol, hydratropic alcohol, hydroxycitronellal, hydroxycitronellal diethyl acetal, hydroxycitronellol, indole, isoamyl alcohol, iso cyclo citral, isoeugenol, isoeugenyl acetate, isomenthone, isopulegyl acetate, isoquinoline, keone, ligustral, linalool, linalool oxide, linalyl formate, lyral, menthone, methyl acetophenone, methyl amyl ketone, methyl anthranilate, methyl benzoate, methyl benzyl acetate, methyl cinnamate, methyl dihydrojasmonate, methyl eugenol, methyl heptenone, methyl heptine carbonate, methyl heptyl ketone, methyl hexyl ketone, methyl isobutenyl tetrahydropyran, methyl-N-methyl anthranilate, methyl beta naphthyl ketone, methyl phenyl carbinyl acetate, methyl salicylate, nerol, nonalactone, octalactone, octyl alcohol (octanol-2), para-anisic aldehyde, para-cresol, para-cresyl methyl ether, para hydroxy phenyl butanone, para-methoxy acetophenone, para-methyl acetophenone, phenoxy ethanol, phenoxyethyl propionate, phenyl acetaldehyde, phenylacetaldehyde diethyl ether, phenylethyl oxyacetaldehyde, phenyl ethyl acetate, phenyl ethyl alcohol, phenyl ethyl dimethyl carbinol, prenyl acetate, propyl butyrate, pulegone, rose oxide, safrole, terpineol, vanillin, viridine, and mixtures thereof.

Nonlimiting examples of other preferred hydrophilic perfume ingredients which can be used in perfume compositions of this invention are allyl heptoate, amyl benzoate, anethole, benzophenone, carvacrol, citral, citronellol, citronellyl nitrile, cyclohexyl ethyl acetate, cymal, 4-decenal, dihydro isojasmonate, dihydro myrcenol, ethyl methyl phenyl glycidate, fenchyl acetate, florhydral, gamma-nonalactone, geranyl formate, geranyl nitrile, hexenyl isobutyrate, alpha-ionone, isobornyl acetate, isobutyl benzoate, isononyl alcohol, isomenthol, para-isopropyl phenylacetaldehyde, isopulegol, linalyl acetate, 2-methoxy naphthalene, menthyl acetate, methyl chavicol, musk ketone, beta naphthol methyl ether, neral, nonyl aldehyde, phenyl heptanol, phenyl hexanol, terpinyl acetate, Veratrol, yara—yara, and mixtures thereof.

The preferred perfume compositions used in the present invention contain at least 4 different hydrophilic perfume ingredients, preferably at least 5 different hydrophilic perfume ingredients, more preferably at least 6 different hydrophilic perfume ingredients, and even more preferably at least 7 different hydrophilic perfume ingredients. Most common perfume ingredients which are derived from natural sources are composed of a multitude of components. When each such material is used in the formulation of the preferred perfume compositions of the present invention, it is counted as one single ingredient, for the purpose of defining the invention.

(b). Low Odor Detection Threshold Perfume Ingredient

The odor detection threshold of an odorous material is the lowest vapor concentration of that material which can be olfactorily detected. The odor detection threshold and some odor detection threshold values are discussed in, e.g., "Standardized Human Olfactory Thresholds", M. Devos et al, IRL Press at Oxford University Press, 1990, and "Compilation of Odor and Taste Threshold Values Data", F. A. Fazzalari, editor, ASTM Data Series DS 48A, American Society for Testing and Materials, 1978, both of said publications being incorporated by reference. The use of small amounts of perfume ingredients that have low odor detection threshold values can improve perfume odor character, even though they are not as hydrophilic as perfume ingredients of group (a) which are given hereinabove. Perfume ingredients that do not belong to group (a) above, but have a significantly low detection threshold, useful in the composition of the present invention, are selected from the group consisting of ambrox, bacdanol, benzyl salicylate, butyl anthranilate, cetalox, damascenone, alpha-damascone, gamma-dodecalactone, ebanol, herbavert, cis-3-hexenyl salicylate, alpha-ionone, beta-ionone, alpha-isomethylionone, lilial, methyl nonyl ketone, gamma-undecalactone, undecylenic aldehyde, and mixtures thereof. These materials are preferably present at low levels in addition to the hydrophilic ingredients of group (a), typically less than about 20%, preferably less than about 15%, more preferably less than about 10%, by weight of the total perfume compositions of the present invention. However, only low levels are required to provide an effect.

There are also hydrophilic ingredients of group (a) that have a significantly low detection threshold, and are especially useful in the composition of the present invention. Examples of these ingredients are allyl amyl glycolate, anethole, benzyl acetone, calone, cinnamic alcohol, coumarin, cyclogalbanate, Cyclal C, cymal, 4-decenal, dihydro isojasmonate, ethyl anthranilate, ethyl-2-methyl butyrate, ethyl methylphenyl glycidate, ethyl vanillin, eugenol, flor acetate, florhydral, fructone, frutene, heliotropin, keone, indole, iso cyclo citral, isoeugenol, lyral, methyl heptine carbonate, linalool, methyl anthranilate, methyl dihydrojasmonate, methyl isobutenyl tetrahydropyran, methyl beta naphthyl ketone, beta naphthol methyl ether, nerol, para-anisic aldehyde, para hydroxy phenyl butanone, phenyl acetaldehyde, vanillin, and mixtures thereof. Use of low odor detection threshold perfume ingredients minimizes the level of organic material that is released into the atmosphere.

Low Molecular Weight Polyols

Low molecular weight polyols with relatively high boiling points, as compared to water, such as ethylene glycol, diethylene glycol, propylene glycol and/or glycerol are preferred optional ingredients for improving odor control performance of the composition of the present invention. Not to be bound by theory, it is believed that the incorporation of a small amount of low molecular weight glycols into the composition of the present invention enhances the formation of the cyclodextrin inclusion complexes as the fabric dries.

It is believed that the polyols' ability to remain on the fabric for a longer period of time than water, as the fabric dries allows it to form ternary complexes with any cyclodextrin present and some malodorous molecules. The addition of the glycols is believed to fill up void space in the cyclodextrin cavity that is unable to be totally filled by some malodor molecules of relatively smaller sizes. Preferably the glycol used is glycerin, ethylene glycol, propylene glycol, dipropylene glycol or mixtures thereof, more preferably ethylene glycol and propylene glycol. Cyclodextrins prepared by processes that result in a level of such polyols are highly desirable, since they can be used without removal of the polyols.

Some polyols, e.g., dipropylene glycol, are also useful to facilitate the solubilization of some perfume ingredients in the composition of the present invention.

Typically, glycol is added to the composition of the present invention at a level of from about 0.01% to about 3%, by weight of the composition, preferably from about 0.05% to about 1%, more preferably from about 0.1% to about 0.5%, by weight of the composition. The preferred weight ratio of low molecular weight polyol to cyclodextrin is from about 2:1,000 to about 20:100, more preferably from about 3:1,000 to about 15:100, even more preferably from about 5:1,000 to about 10:100, and most preferably from about 1:100 to about 7:100.

Optional, but Preferred Ingredients: Aminocarboxylate Chelators

Chelators, e.g., ethylenediaminetetraacetic acid (EDTA), hydroxyethylene-diaminetriacetic acid, diethylenetriamine-pentaacetic acid, and other aminocarboxylate chelators, and mixtures thereof, and their salts, and mixtures thereof, can optionally be used to increase antimicrobial and preservative effectiveness against Gram-negative bacteria, especially Pseudomonas species. Furthermore, aminocarboxylate chelators can help, e.g., maintaining product clarity, protecting fragrance and perfume components, and preventing rancidity and off odors.

The optional chelators are present in the compositions of this invention at levels of, typically, from about 0.01% to about 0.3%, more preferably from about 0.02% to about 0.1%, most preferably from about 0.02% to about 0.05% by weight of the usage compositions to provide antimicrobial efficacy in this invention.

Metal Salts

Metallic salts can be added to the compositions of the present invention for odor absorption and/or antimicrobial benefit. The metallic salts are selected from the group consisting of copper salts, zinc salts, and mixtures thereof.

Preferably the metallic salts are water-soluble zinc salts, copper salts or mixtures thereof, and more preferably zinc salts, especially $ZnCl_2$.

When metallic salts are added to the composition of the present invention they are typically present at a level of from about 0.1% to about 10%, preferably from about 0.2% to about 8%, more preferably from about 0.3% to about 5% by weight of the usage composition. When zinc salts are used as the metallic salt, and a clear solution is desired, it is preferable that the pH of the solution is adjusted to less than about 7, more preferably less than about 6, most preferably, less than about 5, in order to keep the solution clear.

In addition to the metallic salts described above, other salts such as alkali metal carbonate and/or alkali metal bicarbonate salts may also be included in the compositions of the present invention.

Enzymes

Enzymes can be used to control certain types of malodor, especially malodor from urine and other types of excretions, including regurgitated materials. Proteases are especially desirable. The activity of commercial enzymes depends very much on the type and purity of the enzyme being considered.

Enzymes are normally incorporated at levels sufficient to provide up to about 5 mg by weight, preferably from about 0.001 mg to about 3 mg, more preferably from about 0.002 mg to about 1 mg, of active enzyme per gram of the aqueous compositions. Stated otherwise, the aqueous compositions herein can comprise from about 0.0001% to about 0.5%, preferably from about 0.001% to about 0.3%, more preferably from about 0.005% to about 0.2% by weight of a commercial enzyme preparation. Protease enzymes are usually present in such commercial preparations at levels sufficient to provide from 0.0005 to 0.1 Anson units (AU) of activity per gram of aqueous composition. Nonlimiting examples of suitable, commercially available, water soluble proteases are pepsin, tripsin, ficin, bromelin, papain, rennin, and mixtures thereof. Papain can be isolated, e.g., from papaya latex, and is available commercially in the purified form of up to, e.g., about 80% protein, or cruder, technical grade of much lower activity. Other suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE®. The preparation of this enzyme and analogous enzymes is described in British Patent Specification No. 1,243,784 of Novo. Proteolytic enzymes suitable for removing protein-based stains that are commercially available include those sold under the trade names ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985); Protease B (see European Patent Application Serial No. 87303761.8, filed Apr. 28, 1987, and European Patent Application 130,756, Bott et al, published Jan. 9, 1985); and proteases made by Genencor International, Inc., according to one or more of the following patents: Caldwell et al, U.S. Pat. Nos. 5,185,258, 5,204,015 and 5,244,791.

A wide range of enzyme materials and means for their incorporation into liquid compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Other enzyme materials useful for liquid formulations, and their incorporation into such formulations, are disclosed in U.S. Pat. No. 4,261,868, Hora et al, issued Apr. 14, 1981. Enzymes can be stabilized by various techniques, e.g., those disclosed and exemplified in U.S. Pat. No. 3,600,319, issued Aug. 17, 1971 to Gedge, et al., European Patent Application Publication No. 0 199 405, Application No. 86200586.5, published Oct. 29, 1986, Venegas, and in U.S. Pat. No. 3,519,570. All of the above patents and applications are incorporated herein, at least in pertinent part.

Enzyme-polyethylene glycol conjugates are also preferred. Such polyethylene glycol (PEG) derivatives of enzymes, wherein the PEG or alkoxy-PEG moieties are coupled to the protein molecule through, e.g., secondary amine linkages. Suitable derivatization decreases immunogenicity, thus minimizes allergic reactions, while still maintaining some enzymatic activity. An example of protease-PEG's is PEG-subtilisin Carlsberg from *B. lichenniformis* coupled to methoxy-PEGs through secondary amine linkage, and is available from Sigma-Aldrich Corp., St. Louis, Mo.

Preservative

Solubilized, water-soluble, antimicrobial preservatives can be added to the compositions of the present invention.

Antimicrobial preservatives useful in the present invention include biocidal compounds, i.e., substances that kill microorganisms, or biostatic compounds, i.e., substances that inhibit and/or regulate the growth of microorganisms. List of suitable preservatives is found in U.S. Pat. No. 5,714,137.

Preferred levels of preservative are from about 0.0001% to about 0.5%, more preferably from about 0.0002% to about 0.2%, most preferably from about 0.0003% to about 0.1%, by weight of the usage composition.

In order to reserve most of the cyclodextrins for odor control, the cyclodextrin to preservative molar ratio should be greater than about 5:1, preferably greater than about 10:1, more preferably greater than about 50:1, even more preferably greater than about 100:1.

Wrinkle Control Agent

A fabric wrinkle control agent, preferably selected from the group consisting of: fiber lubricant, shape retention polymer, hydrophilic plasticizer, lithium salt, and mixtures thereof, may also be incorporated into the compositions of the present invention. Preferably the fabric wrinkle control agent, like the other ingredients, are cyclodextrin-compatible. Nonlimiting examples of fabric wrinkle control agents are silicones, synthetic solid particles (e.g., Velustrol P-40 oxidized polyethylene emulsion available from Clariant), mono- and polycarboxylic acids, acrylates, acrylamides, esters, amides and imides of carboxylic acids, starches and their derivatives, chitins and their derivatives.

Nonlimiting examples of the preferred shape retention polymers that are commercially available are: polyvinylpyrrolidone/dimethylaminoethyl methacrylate copolymer, such as Copolymer 958®, molecular weight of about 100,000 and Copolymer 937, molecular weight of about 1,000,000, available from GAF Chemicals Corporation; adipic acid/dimethylaminohydroxypropyl diethylenetriamine copolymer, such as Cartaretin F-4® and F-23, available from Sandoz Chemicals Corporation; methacryloyl ethyl betaine/methacrylates copolymer, such as Diaformer Z-SM®, available from Mitsubishi Chemicals Corporation; polyvinyl alcohol copolymer resin, such as Vinex 2019®, available from Air Products and Chemicals or Moweol®, available from Clariant; adipic acid/epoxypropyl diethylenetriamine copolymer, such as Delsette 101®, available from Hercules Incorporated; polyamine resins, such as Cypro 515®, available from Cytec Industries; polyquaternary amine resins, such as Kymene 557H®, available from Hercules Incorporated; and polyvinylpyrrolidone/acrylic acid, such as Sokalan EG 310®, available from BASF.

When silicone is present, it is present at least an effective amount to provide lubrication of the fibers, typically from about 0.1% to about 5%, preferably from about 0.2% to about 3%, more preferably from about 0.3% to about 2%, by weight of the usage composition.

When solid polymeric particles are present, they are present at an effective amount to provide lubrication of the fibers, typically from about 0.01% to about 3%, preferably from about 0.05% to about 1%, more preferably from about 0.1% to about 0.5%, by weight of the usage composition.

The adhesive polymer is present in the composition in a sufficient amount to result in an amount of from about 0.001% to about 1%, preferably from about 0.01% to about 0.5%, more preferably from about 0.02% to about 0.4% by weight of polymer per weight of dry fabrics.

Concentrated compositions can also be used in order to provide a less expensive product. When a concentrated product is used, i.e., when the wrinkle reducing active is from about 5% to about 50%, by weight of the concentrated composition, it is preferable to dilute the composition before treating fabric. Preferably, the wrinkle reducing active is diluted with about 50% to about 10,000%, more preferably from about 50% to about 8,000%, and even more preferably from about 50% to about 5,000%, by weight of the composition, of water.

When a hydrophilic plasticizer is used, it is present in the at a level of from 0.01% to 5%, preferably from 0.05% to 2%, more preferably from 0. 1% to 1% by weight of the usage composition.

Useful levels of lithium salts are from about 0.1% to about 10%, preferably from about 0.5% to about 7%, more preferably from about 1% to about 5%, by weight of the usage composition.

Other Optional Ingredients

The composition of the present invention can optionally contain adjunct odor-controlling materials, chelating agents, antistatic agents, insect and moth repelling agents, colorants, especially bluing agents, antioxidants, superspreaders, clarifiers, other silicone compounds and emulsions, viscosity control agents, anti-clogging agents, buffering agents, fabric care saccharides, polysaccharides, oligosaccharides, and mixtures thereof in addition to the cyclodextrin molecules. The total level of optional ingredients is low, preferably less than about 5%, more preferably less than about 3%, and even more preferably less than about 2%, by weight of the usage composition. These optional ingredients exclude the other ingredients specifically mentioned hereinbefore. Incorporating adjunct odor-controlling materials can enhance the capacity of the cyclodextrin to control odors as well as broaden the range of odor types and molecule sizes, which can be controlled. Such materials include, for example, metallic salts, water-soluble cationic and anionic polymers, zeolites, water-soluble bicarbonate salts, and mixtures thereof.

Optional Viscosity Control Compounds—Electrolytes are useful for lowering viscosity in the present compositions. Not to be bound by theory, but when carboxylic acid polymers have some degree of charge, these can build viscosity via electrostatic repulsion, electrolytes can provide shielding between charges that reduces electrostatic repulsion and thus reduces viscosity.

Inorganic salts suitable for reducing dilution viscosity include $MgI_2$, $MgBr_2$, $MgCl_2$, $Mg(NO_3)_2$, $Mg_3(PO_4)_2$, $Mg_2P_2O_7$, $MgSO_4$, magnesium silicate, NaI, NaBr, NaCl, NaF, $Na_3(PO_4)$, $NaSO_3$, $Na_2SO_4$, $Na_2SO_3$, $NaNO_3$, $NaIO_3$, $Na_3(PO_4)$, $Na_4P_2O_7$, sodium silicate, sodium metasilicate, sodium tetrachloroaluminate, sodium tripolyphosphate (STPP), $Na_2Si_3O_7$, sodium zirconate, $CaF_2$, $CaCl_2$, $CaBr_2$, $CaI_2$, $CaSO_4$, $Ca(NO_3)_2$, Ca, KI, KBr, KCl, KF, $KNO_3$, $KIO_3$, $K_2SO_4$, $K_2SO_3$, $K_3(PO_4)$, $K_4(P_2O_7)$, potassium pyrosulfate, potassium pyrosulfite, LiI, LiBr, LiCl, LiF, $LiNO_3$, $AlF_3$, $AlCl_3$, $AlBr_3$, $AlI_3$, $Al_2(SO_4)_3$, $Al(PO_4)$, $Al(NO_3)_3$, aluminum silicate; including hydrates of these salts and including combinations of these salts or salts with mixed cations e.g. potassium alum $AlK(SO_4)_2$ and salts with mixed anions, e.g. potassium tetrachloroaluminate and sodium tetrafluoroaluminate. Salts incorporating cations from groups IIIa, IVa, Va, VIa, VIIa, VIII, Ib, and IIb on the periodic chart with atomic numbers>13 are also useful in reducing dilution viscosity but less preferred due to their tendency to change oxidation states and thus they can adversely affect the odor or color of the formulation or lower weight efficiency. Salts with cations from group Ia or IIa with atomic numbers>20 as well as salts with cations from the lactinide or actinide series are useful in reducing dilution viscosity, but less preferred due to lower weight efficiency or toxicity. Mixtures of above salts are also useful.

Organic salts useful in this invention include, magnesium, sodium, lithium, potassium, zinc, and aluminum salts of the carboxylic acids including formate, acetate, proprionate, pelargonate, citrate, gluconate, lactate aromatic acids e.g. benzoates, phenolate and substituted benzoates or phenolates, such as phenolate, salicylate, polyaromatic acids terephthalates, and polyacids e.g. oxylate, adipate, succinate, benzenedicarboxylate, benzenetricarboxylate. Other useful organic salts include carbonate and/or hydrogencarbonate ($HCO_3^{-1}$) when the pH is suitable, alkyl and aromatic sulfates and sulfonates e.g. sodium methyl sulfate, benzene sulfonates and derivatives such as xylene sulfonate, and amino acids when the pH is suitable. Electrolytes can comprise mixed salts of the above, salts neutralized with mixed cations such as potassium/sodium tartrate, partially neutralized salts such as sodium hydrogen tartrate or potassium hydrogen phthalate, and salts comprising one cation with mixed anions.

Other useful organic salts include amino compounds that be protonated to form cationic salts either prior to addition or in situ such as Tris Amino® (2-amino-2-hydroxymethyl-1,3-propanediol) or AMPD™ (2-amino-2-methyl-1,3-propanediol) Both available from Angus Chemical Company.

Generally, inorganic electrolytes are preferred over organic electrolytes for better weight efficiency and lower costs. Mixtures of inorganic and organic salts can be used. Typical levels of electrolyte in the compositions are less than about 10%. Preferably from about 0.5% to about 5% by weight, more preferably from about 0.75% to about 2.5%, and most preferably from about 1% to about 2% by weight of the fabric softener composition.

Optional Antistatic Agents—The composition of the present invention can optionally contain additional effective amounts of other antistatic agent to provide the treated clothes with in-wear static. Preferred antistatic agents are those that are water soluble in at least an effective amount, such that the composition remains a clear solution. Examples of these antistatic agents are monoalkyl cationic quaternary ammonium compounds, e.g., mono($C_{10}$–$C_{14}$ alkyl)trimethyl ammonium halide, such as monolauryl trimethyl ammonium chloride, hydroxycetyl hydroxyethyl dimethyl ammonium chloride, available under the trade name Dehyquart E® from Henkel, and ethyl bis(polyethoxy ethanol) alkylammonium ethylsulfate, available under the trade name Variquat 66® from Witco Corp., polyethylene glycols, polymeric quaternary ammonium salts, such as polymers conforming to the general formula:

$$-[N(CH_3)_2-(CH_2)_3-NH-CO-NH-(CH_2)_3-N(CH_3)_2^{+}-CH_2CH_2OCH_2CH_2]-_x^{2+}2x[Cl^-]$$

available under the trade name Mirapol A-15® from Rhône-Poulenc, and $$-[N(CH_3)_2-(CH_2)_3-NH-CO-(CH_2)_4-CO-NH-(CH_2)_3-N(CH_3)_2-(CH_2CH_2OCH_2CH_2]-_x^{+}x[Cl^-],$$

available under the trade name Mirapol AD-1® from Rhône-Poulenc, quaternized polyethyleneimines, vinylpyrrolidone/methacrylamidopropyltrimethylammonium chloride copolymer, available under the trade name Gafquat HS-100® from GAF; triethonium hydrolyzed collagen ethosulfate, available under the trade name Quat-Pro E® from Maybrook; neutralized sulfonated polystyrene, available, e.g., under the trade name Versa TL-130® from Alco Chemical, neutralized sulfonated styrene/maleic anhydride copolymers, available, e.g., under the trade name Versa TL-4® from Alco Chemical; and mixtures thereof.

It is preferred that a no foaming, or low foaming, agent is used, to avoid foam formation during fabric treatment. It is also preferred that polyethoxylated agents such as polyethylene glycol or Variquat 66® are not used when alpha-cyclodextrin is used. The polyethoxylate groups have a strong affinity to, and readily complex with, alpha-cyclodextrin which in turn depletes the uncomplexed cyclodextrin available for odor control.

When an antistatic agent is used it is typically present at a level of from about 0.05% to about 10%, preferably from about 0.1% to about 5%, more preferably from about 0.3% to about 3%, by weight of the usage composition.

Optional Colorant—Colorants and dyes, especially bluing agents, can be optionally added to the wrinkle control compositions for visual appeal and performance impression. When colorants are used, they are used at extremely low levels to avoid fabric staining. Preferred colorants for use in the present compositions are highly water-soluble dyes, e.g., Liquitint® dyes available from Milliken Chemical Co. Non-limiting examples of suitable dyes are, Liquitint Blue HP®, Liquitint Blue 65®, Liquitint Patent Blue®, Liquitint Royal Blue®, Liquitint Experimental Yellow 8949-43®, Liquitint Green HMC®, Liquitint Yellow II®, and mixtures thereof, preferably Liquitint Blue HP®, Liquitint Blue 65®, Liquitint Patent Blue®, Liquitint Royal Blue®, Liquitint Experimental Yellow 8949-43®, and mixtures thereof.

Optional Anti-clogging Agent—Optional anti-clogging agent which enhances the wetting and anti-clogging properties of the composition, especially when starch is present, is chosen from the group of polymeric glycols of alkanes and olefins having from 2 to about 6, preferably 2 carbon atoms. The anti-clogging agent inhibits the formation of "plugs" in the spray nozzle. An example of the preferred anti-clogging agent is polyethylene glycol having an average molecular weight of from about 800 to about 12,000, more preferably from about 1,400 to about 8,000. When used, the anti-clogging agent is present at a level of from about 0.01% to about 1%, preferably from about 0.05% to about 0.5%, more preferably, from about 0.1% to about 0.3% by weight of the usage composition.

3. Article of Manufacture

The present invention also encompasses articles of manufacture comprising (1) a container, (2) composition, and (3) optionally, but preferably, instructions. A variety of containers, compositions, and instructions can be utilized in the present articles of manufacture as described hereinafter.

The present articles of manufacture preferably comprise a set of instructions that are typically in association with the container. The set of instructions typically communicates to the consumer of the present articles to dispense the composition in an amount effective to provide a solution to problems involving, and/or provision of a benefit related to, those selected from the group consisting of: killing or reducing the level of, microorganisms; reducing odors; and/or reducing static in addition to the reduction of wrinkles. It is important that the consumer of the present article be aware of these benefits, since otherwise the consumer would not know that the composition would solve these problems or combination of problems and/or provide these benefits or combination of benefits.

As used herein, the phrase "in association with" means the set of instructions are either directly printed on the container or substrate itself or presented in a separate manner including, but not limited to, a brochure, print advertisement, electronic advertisement, and/or broadcast communication, so as to communicate the set of instructions to a consumer of the article of manufacture. The set of instructions preferably comprises the instruction to apply an effective amount of the composition, preferably by spraying, to provide the indicated benefit, e.g., wrinkle reduction, and, optionally, antimicrobial action, and/or anti-static effect, etc. and, also optionally, the provision of odor control and/or reduction.

A more complete disclosure of the instructions is presented hereinafter.

(1) Container

These include disposable containers that are typically suitable for use in storing cleaning compositions. Typically these will be constructed of any suitable polymer, eg HDPE, and can be opague, translucent or transparent. Preferably, the container is a bottle. In one preferred embodiment the instructions, as described in more detail hereinafter, are permanently, or semi-permanently attached or, printed on the container.

In another alternative embodiment, the container is a disposable reservoir, which is designed to be detachably mounted into an apparatus, such as a dewrinkling cabinet/apparatus. The container would affix to the apparatus via a lock and key system. The consumer would simply affix the container in the apparatus in accordance with the instructions. The composition would then be directly dispensed on the garments from the contrainer by the apparatus as needed. The container is removed and disposed of when the all the composition has been used. The spent container could be replaced with a silimar disposable container or with a premant resiviour, which is supplied with the apparatus.

(2) Composition

The present article of manufacture can comprise a wrinkle controlling composition according to the compositions described hereinbefore. The present compositions are preferably held in a container such as a disposable bottle.

(3) Set of Instructions

As discussed hereinbefore, the article of manufacture also comprises the composition of the present invention in a container in association with a set of instructions to use the composition in an amount effective to provide a solution to problems involving and/or provision of a benefit related to refreshing, deodorizing and finishing a garment. It is important that the consumer be aware of these additional benefits, since otherwise the consumer would not know that the composition would solve these problems and /or provide these benefits.

As used herein, the phrase "in association with" means the set of instructions are either directly printed on the container itself or presented in a separate manner including, but not limited to, a brochure, print advertisement, electronic advertisement, and/or verbal communication, so as to communicate the set of instructions to a consumer of the article of manufacture. The set of instructions preferably comprises the instruction to identify the apparael characteristics of a garment, preferably by versioning, identify a suitable refreshing deodorizing and finishing composition and to apply an effective amount of the selected refreshing deodorizing and finishing composition composition, preferably by spraying on to the fabric to refresh deodorize and finish the garment.

The set of instructions of the present articles can comprise the instruction or instructions to achieve the benefits discussed herein by carrying out any of the methods of using compositions, including the compositions, as described herein.

The following are non-limiting examples of the present invention. All percentages, ratios, and parts herein, in the Specification, Examples, and claims are by weight and are the normal approximations unless otherwise stated and all references are incorporated by reference.

EXAMPLES

The following are Examples of refreshing, deodorizing and finishing compositions of the present invention

Example 1

The following are examples of refreshing, deodorizing and finishing compositions that provide a treated garment with a crisp finish.

| | Crisp Formula | | | | | | | | | |
|---|---|---|---|---|---|---|---|---|---|---|
| Ingredients | A | B | C | D | E | F | G | H | I | J |
| PAA | 0.4 | 0.4 | 0.4 | 0.25 | 0.25 | 0.25 | | | | |
| AAtBA | | | | | | | 0.6 | 0.6 | | |
| PVP/AA | | | | | | | | | 0.5 | 0.5 |
| Super spreader | 0.1 | | | 0.1 | | | 0.1 | | 0.1 | |
| Silwet L77 | | 0.1 | | | 0.1 | | | | | |
| Clarifier (Cremaphor HCO-60) | | 0.075 | | | 0.075 | | | | | |
| Silwet L7608 | | | 0.1 | | | 0.1 | | 0.1 | | 0.1 |
| Preservative | 0.015 | 0.015 | 0.015 | 0.015 | 0.015 | 0.015 | 0.015 | 0.015 | 0.015 | 0.015 |
| Cyclodextrin (3.3–5.5 sub) | 0.35 | 0.35 | 0.35 | 0.35 | 0.35 | 0.35 | 0.35 | 0.35 | 0.35 | 0.35 |
| Diethylene glycol | 0.1 | 0.1 | 0.1 | 0.1 | 0.1 | 0.1 | 0.1 | 0.1 | 0.1 | 0.1 |
| NaOH | 0.001 | 0.001 | 0.001 | 0.001 | 0.001 | 0.001 | 0.001 | 0.001 | 0.001 | 0.001 |
| Perfume | 0.05 | 0.05 | 0.05 | 0.05 | 0.05 | 0.05 | 0.05 | 0.05 | 0.05 | 0.05 |
| Water | Bal | Bal | Bal | Bal | Bal | Bal | Bal | Bal | Bal | Bal |
| pH | 5–7 | 5–7 | 5–7 | 5–7 | 5–7 | 5–7 | 9–10 | 9–10 | 9–10 | 9–10 |

Example 2

The following are examples of refreshing, deodorizing and finishing compositions that provide a treated garment with a soft finish.

| | Soft Formulas | | | | | | | | | | |
|---|---|---|---|---|---|---|---|---|---|---|---|
| Ingredients | A | B | C | D | E | F | G | H | I | J | K |
| Cyclomethicone D5 | 1 | 0.5 | 1 | 0.5 | | | | | | | |
| Short chain silicone (DC 2-1865) | | | | | 0.75 | 0.75 | | | | | |
| Schercotaine IAB | 0.25 | 0.25 | | | 0.25 | | 0.25 | 0.25 | 0.25 | | |
| KRB-Base | | | 0.25 | 0.25 | | 0.25 | | | | 0.25 | 0.25 |
| Super spreader | | | | | 0.1 | 0.1 | | 0.1 | | 0.1 | 0.1 |
| Clarifier (cremaphor HCO-60) | 0.075 | 0.075 | | | | | | | | | |
| Silwet L77 | 1 | 0.5 | 1 | 0.5 | | | | | | | |
| Silwet L7200 | | | | | | | 1 | 1 | 0.5 | 1 | 1 |
| Silwet L7657 | | | | | | | 0.25 | 0.25 | 0.25 | | |
| Silwet L7608 | | | | | | | | | | | |
| Preservative | 0.015 | 0.015 | 0.015 | 0.015 | 0.015 | 0.015 | 0.015 | 0.015 | 0.015 | 0.015 | 0.015 |
| Cyclodextrin (3.3–5.5 sub) | 0.35 | 0.35 | 0.35 | 0.35 | 0.35 | 0.35 | 0.35 | 0.35 | 0.35 | 0.35 | 0.35 |
| Diethylene glycol | 0.1 | 0.1 | 0.1 | 0.1 | 0.1 | 0.1 | 0.1 | 0.1 | 0.1 | 0.1 | 0.1 |
| Neodol 23-3 | 0.25 | 0.125 | 0.25 | 0.125 | | | | | | | |
| C45-AS | 0.05 | 0.025 | 0.05 | 0.025 | | | | | | | |
| NaOH | 0.001 | 0.001 | 0.001 | 0.001 | 0.001 | 0.001 | 0.001 | 0.001 | 0.001 | 0.001 | 0.001 |
| Perfume | 0.05 | 0.05 | 0.05 | 0.05 | 0.05 | 0.05 | 0.05 | 0.05 | 0.05 | 0.05 | 0.05 |
| Water | Bal | Bal | Bal | Bal | Bal | Bal | Bal | Bal | Bal | Bal | Bal |
| pH | 5–7 | 5–7 | 5–7 | 5–7 | 5–7 | 5–7 | 5–7 | 5–7 | 5–7 | 5–7 | 5–7 |

Example 3

The following are examples of refreshing, deodorizing and finishing compositions that provide a treated garment with either a soft finish or a crisp finish (2-in-1 compositions).

| | 2:1 Formulas | | | | | | | | | |
|---|---|---|---|---|---|---|---|---|---|---|
| Ingredients | A | B | C | D | E | F | G | H | I | J |
| PAA | 0.25 | 0.25 | 0.25 | 0.25 | 0.25 | | | | | |
| AAtBA | | | | | | 0.25 | 0.25 | 0.25 | | |

-continued

| | 2:1 Formulas | | | | | | | | | |
|---|---|---|---|---|---|---|---|---|---|---|
| Ingredients | A | B | C | D | E | F | G | H | I | J |
| PVP/AA | | | | | | | | | 0.5 | 0.5 |
| Cyclomethicone D5 | | 1 | | | | 1 | | | | |
| Short chain silicone (DC 2-1865) | | | 0.75 | 1 | 1.5 | | | | | 1 |
| Schercotaine IAB | | | | | 0.15 | | | | | |
| Super spreader | 0.1 | | 0.1 | | 0.1 | | 0.1 | 0.1 | 0.1 | |
| Clarifier (cremaphor HCO-60) | | 0.075 | | | | 0.075 | | | | |
| Silwet L77 | | 1 | | | | 1 | | | | |
| Silwet L7200 | 1 | | 0.75 | 0.5 | | | 0.75 | 1 | 1 | 0.5 |
| Silwet L7657 | | | | | | | | | | |
| Silwet L7608 | | | | 0.1 | | | | | | 0.1 |
| Preservative | 0.015 | 0.015 | 0.015 | 0.015 | 0.015 | 0.015 | 0.015 | 0.015 | 0.015 | 0.015 |
| Cyclodextrin (3.3–5.5 sub) | 0.35 | 0.25 | 0.35 | 0.35 | 0.35 | 0.35 | 0.35 | 0.35 | 0.35 | 0.35 |
| Diethylene glycol | 0.1 | 0.1 | 0.1 | 0.1 | 0.1 | 0.1 | 0.1 | 0.1 | 0.1 | 0.1 |
| Neodol 23-3 | | 0.25 | | | | 0.25 | | | | |
| C45-AS | | 0.05 | | | | 0.05 | | | | |
| NaOH | 0.001 | 0.001 | 0.001 | 0.001 | 0.001 | 0.001 | 0.001 | 0.001 | 0.001 | 0.001 |
| Perfume | 0.05 | 0.05 | 0.05 | 0.05 | 0.05 | 0.05 | 0.05 | 0.05 | 0.05 | 0.05 |
| Water | Bal | Bal | Bal | Bal | Bal | Bal | Bal | Bal | Bal | Bal |
| pH | 8–10 | 8–10 | 8–10 | 8–10 | 8–10 | 8–10 | 8–10 | 8–10 | 8–10 | 8–10 |

Example 4

The following are examples of refreshing, deodorizing and finishing compositions that provide a treated garment with an antibacterial finish.

| | Antibacterial Crisp Formulas | | | | | | | | | |
|---|---|---|---|---|---|---|---|---|---|---|
| Ingredients | A | B | C | D | E | F | G | H | I | J |
| PAA | 0.4 | 0.4 | 0.4 | 0.25 | 0.25 | 0.25 | | | | |
| AAtBA | | | | | | | 0.6 | 0.6 | | |
| PVP/AA | | | | | | | | | 0.5 | 0.5 |
| Super spreader | 0.1 | | | 0.1 | | | 0.1 | | 0.1 | |
| Silwet L77 | | 0.1 | | | 0.1 | | | | | |
| Clarifier (Cremaphor HCO-60) | | 0.075 | | | 0.075 | | | | | |
| Silwet L7608 | | | 0.1 | | | 0.1 | | 0.1 | | 0.1 |
| Preservative | 0.015 | 0.015 | 0.015 | 0.015 | 0.015 | 0.015 | 0.015 | 0.015 | 0.015 | 0.015 |
| Cyclodextrin (3.3–5.5 sub) | 0.35 | 0.35 | 0.35 | 0.35 | 0.35 | 0.35 | 0.35 | 0.35 | 0.35 | 0.35 |
| Diethylene glycol | 0.1 | 0.1 | 0.1 | 0.1 | 0.1 | 0.1 | 0.1 | 0.1 | 0.1 | 0.1 |
| NaOH | 0.001 | 0.001 | 0.001 | 0.001 | 0.001 | 0.001 | 0.001 | 0.001 | 0.001 | 0.001 |
| Perfume | 0.05 | 0.05 | 0.05 | 0.05 | 0.05 | 0.05 | 0.05 | 0.05 | 0.05 | 0.05 |
| Triclosan | 0.15 | 0.15 | 0.15 | 0.15 | 0.15 | 0.15 | 0.15 | 0.15 | 0.15 | 0.15 |
| Water | Bal | Bal | Bal | Bal | Bal | Bal | Bal | Bal | Bal | Bal |
| pH | 5–7 | 5–7 | 5–7 | 5–7 | 5–7 | 5–7 | 9–10 | 9–10 | 9–10 | 9–10 |

| | Antibacterial Presiva Soft Formulas | | | | | | | | | | |
|---|---|---|---|---|---|---|---|---|---|---|---|
| Ingredients | A | B | C | D | E | F | G | H | I | J | K |
| Cyclomethicone D5 | 1 | 0.5 | 1 | 0.5 | | | | | | | |
| Short chain silicone (DC 2-1865) | | | | | 0.75 | 0.75 | | | | | |
| Schercotaine IAB | 0.25 | 0.25 | | | 0.25 | | 0.25 | 0.25 | 0.25 | | |
| KRB-Base | | | 0.25 | 0.25 | | 0.25 | | | | 0.25 | 0.25 |
| Super spreader | | | | | 0.1 | 0.1 | | | | 0.1 | 0.1 |
| Clarifier (cremaphor HCO-60) | 0.075 | 0.075 | | | | | | | | | |
| Silwet L77 | 1 | 0.5 | 1 | 0.5 | | | | | | | |
| Silwet L7200 | | | | | | | 1 | 1 | 0.5 | 1 | 1 |
| Silwet L7657 | | | | | | | 0.25 | 0.25 | 0.25 | | |
| Silwet L7608 | | | | | | | | | | | |

-continued

| Ingredients | Antibacterial Presiva Soft Formulas | | | | | | | | | | |
|---|---|---|---|---|---|---|---|---|---|---|---|
| | A | B | C | D | E | F | G | H | I | J | K |
| Preservative | 0.015 | 0.015 | 0.015 | 0.015 | 0.015 | 0.015 | 0.015 | 0.015 | 0.015 | 0.015 | 0.015 |
| Cyclodextrin (3.3–5.5 sub) | 0.35 | 0.35 | 0.35 | 0.35 | 0.35 | 0.35 | 0.35 | 0.35 | 0.35 | 0.35 | 0.35 |
| Diethylene glycol | 0.1 | 0.1 | 0.1 | 0.1 | 0.1 | 0.1 | 0.1 | 0.1 | 0.1 | 0.1 | 0.1 |
| Neodol 23-3 | 0.25 | 0.125 | 0.25 | 0.125 | | | | | | | |
| C45-AS | 0.05 | 0.025 | 0.05 | 0.025 | | | | | | | |
| NaOH | 0.001 | 0.001 | 0.001 | 0.001 | 0.001 | 0.001 | 0.001 | 0.001 | 0.001 | 0.001 | 0.001 |
| Perfume | 0.05 | 0.05 | 0.05 | 0.05 | 0.05 | 0.05 | 0.05 | 0.05 | 0.05 | 0.05 | 0.05 |
| Triclosan | 0.1 | 0.1 | 0.1 | 0.1 | 0.05 | 0.1 | 0.05 | 0.1 | 0.1 | 0.1 | 0.1 |
| Bardac | | | | | 0.1 | | 0.1 | | | | |
| Water | Bal | Bal | Bal | Bal | Bal | Bal | Bal | Bal | Bal | Bal | Bal |
| pH | 5–7 | 5–7 | 5–7 | 5–7 | 5–7 | 5–7 | 5–7 | 5–7 | 5–7 | 5–7 | 5–7 |

Example 5

The following are examples of refreshing, deodorizing and finishing compositions that provide a treated garment with either a soft finish crisp finish or an antibacterial finish (3-in-1 compositions).

| Ingredients | 3:1 Formulas | | | | | | | | | |
|---|---|---|---|---|---|---|---|---|---|---|
| | A | B | C | D | E | F | G | H | I | J |
| PAA | 0.25 | 0.25 | 0.25 | 0.25 | 0.25 | | | | | |
| AAtBA | | | | | | 0.25 | 0.25 | 0.25 | | |
| PVP/AA | | | | | | | | | 0.5 | 0.5 |
| Cyclomethicone D5 | | 1 | | | | 1 | | | | |
| Short chain silicone (DC 2-1865) | | | 0.75 | 1 | 1.5 | | | | | 1 |
| Schercotaine IAB | | | | | 0.15 | | | | | |
| Super spreader | 0.1 | | 0.1 | | 0.1 | | 0.1 | 0.1 | 0.1 | |
| Clarifier (cremaphor HCO-60) | | 0.075 | | | | 0.075 | | | | |
| Silwet L77 | | 1 | | | | 1 | | | | |
| Silwet L7200 | 1 | | 0.75 | 0.5 | | | 0.75 | 1 | 1 | 0.5 |
| Silwet L7657 | | | | | | | | | | |
| Silwet L7608 | | | | 0.1 | | | | | | 0.1 |
| Preservative | 0.015 | 0.015 | 0.015 | 0.015 | 0.015 | 0.015 | 0.015 | 0.015 | 0.015 | 0.015 |
| Cyclodextrin (3.3–5.5 sub) | 0.35 | 0.25 | 0.35 | 0.35 | 0.35 | 0.35 | 0.35 | 0.35 | 0.35 | 0.35 |
| Diethylene glycol | 0.1 | 0.1 | 0.1 | 0.1 | 0.1 | 0.1 | 0.1 | 0.1 | 0.1 | 0.1 |
| Neodol 23-3 | | 0.25 | | | | 0.25 | | | | |
| C45-AS | | 0.05 | | | | 0.05 | | | | |
| NaOH | 0.001 | 0.001 | 0.001 | 0.001 | 0.001 | 0.001 | 0.001 | 0.001 | 0.001 | 0.001 |
| Perfume | 0.05 | 0.05 | 0.05 | 0.05 | 0.05 | 0.05 | 0.05 | 0.05 | 0.05 | 0.05 |
| Biocide | 0.15 | 0.15 | 0.15 | 0.15 | 0.15 | 0.15 | 0.15 | 0.15 | 0.15 | 0.15 |
| Water | Bal | Bal | Bal | Bal | Bal | Bal | Bal | Bal | Bal | Bal |
| pH | 8–10 | 8–10 | 8–10 | 8–10 | 8–10 | 8–10 | 8–10 | 8–10 | 8–10 | 8–10 |

Example 6

The following are examples of refreshing, deodorizing and finishing compositions that are designed for application to nonfibrous materials such as leather, PVC, rubber, etc.

| Ingredients | A | B | C | D | E | F | H | H | I | J | K | L |
|---|---|---|---|---|---|---|---|---|---|---|---|---|
| Cyclomethicone D5 | 1 | 0.5 | 1 | 0.5 | | | | | | | | |
| Short chain silicone (DC 2-1865) | | | | | 0.75 | 0.75 | | | | | | |
| Schercotaine IAB | 0.25 | 0.25 | | | 0.25 | | 0.25 | 0.25 | 0.25 | 0.25 | | |
| KRB-Base | | | 0.25 | 0.25 | | 0.25 | | | | | 0.25 | 0.25 |
| Super spreader | | | | | 0.1 | 0.1 | | | 0.1 | | 0.1 | 0.1 |
| Clarifier (cremaphor HCO-60) | 0.075 | 0.075 | | | | | | | | | | |

-continued

| Ingredients | A | B | C | D | E | F | H | H | I | J | K | L |
|---|---|---|---|---|---|---|---|---|---|---|---|---|
| Silwet L77 | 1 | 0.5 | 1 | 0.5 | | | | | | | | |
| Silwet L7200 | | | | | | | 1 | 1 | 1 | 0.5 | 1 | 1 |
| Silwet L7657 | | | | | | | 0.25 | 0.25 | 0.25 | 0.25 | | |
| Silwet L7608 | | | | | | | | | | | | |
| Preservative | | | | | | | | 0.015 | 0.015 | 0.015 | 0.015 | 0.015 |
| Cyclodextrin (3.3–5.5 sub) | 0.35 | 0.35 | 0.35 | 0.35 | 0.35 | 0.35 | 0.35 | 0.35 | 0.35 | 0.35 | 0.35 | 0.35 |
| Diethylene glycol | 0.1 | 0.1 | 0.1 | 0.1 | 0.1 | 0.1 | 0.1 | 0.1 | 0.1 | 0.1 | 0.1 | 0.1 |
| Neodol 23-3 | 0.25 | 0.125 | 0.25 | 0.125 | | | | | | | | |
| C45-AS | 0.05 | 0.025 | 0.05 | 0.025 | | | | | | | | |
| NaOH | 0.001 | 0.001 | 0.001 | 0.001 | 0.001 | 0.001 | 0.001 | 0.001 | 0.001 | 0.001 | 0.001 | 0.001 |
| Perfume | 0.05 | 0.05 | 0.05 | 0.05 | 0.05 | 0.05 | 0.05 | 0.05 | 0.05 | 0.05 | 0.05 | 0.05 |
| Orthophenylphenol | 0.25 | 0.25 | 0.25 | 0.25 | 0.25 | 0.25 | 0.25 | | | | | 0.25 |
| Water | Bal | Bal | Bal | Bal | Bal | Bal | Bal | Bal | Bal | Bal | Bal | Bal |
| pH | 5.5 | 5.5 | 5.5 | 5.5 | 5.5 | 5.5 | 5.5 | 5.5 | 5.5 | 5.5 | 5.5 | 5.5 |

Example 7

The following is an example of how the apparel characteristics of a garment are identified.

The edge of a red and blue 100% cotton polo knit shirt is pulled lightly on while on a hanger. The shirt does not readily stretch, but does recover to a small extent. The shirt is not a stretch fabric.

Next the stiffness of the garment is determined. A flow garment will allow have no inherent impedance to movement, while a crisp will impede body movement. In the present case the shirt resists draping over the and light external forces do not induce movement relative to the wearer. The shirt is a crisp garment.

Suitable formulations include crisp formulas, 2in1 formulas, and antibacterial formulas. A crisp formula is selected and applied to the garment in a dewrinkling apparatus.

What is claimed is:

1. A method for the selection and treatment of a garment with a refreshing, deodorizing and finishing composition comprising at least of the steps of:

(a) identifying the apparel characteristics of said garment;

(b) identifying the finish desired for said garment; and (c) identifying at least one refreshing, deodorizing and finishing composition appropriate for the apparel characteristics identified in (a) and the finish identified in (b) of said garment;

(d) selecting an appropriate refreshing, deodorizing and finishing composition; and (e) treating said garment with an effective amount of the appropriate refreshing, deodorizing and finishing composition selected in (d), wherein said apparel characteristics of said garment are determined by versioning.

2. The method according to claim 1 wherein said apparel characteristics of said garment determined by versioning and are selected from the group consisting of crisp, flow, stretch and combinations thereof.

3. The method according to claim 1 wherein said finish identified in (b) is either a crisp finish or soft finish.

4. The method according to claim 1 wherein said treatment of said garment in (d) is in an apparatus.

5. The method according to claim 4 wherein said apparatus is a cabinet.

6. The method according to claim 1 wherein the appropriate refreshing, deodorizing and finishing composition comprises:

(i) a carrier;

(ii) an effective amount to absorb or reduce malodor, of odor control agent;

(iii) optionally, an effective amount of a wrinkle reducing active;

(iv) optionally, an effective amount of a fabric softener;

wherein said composition has a pH of from about 3 to about 11 a viscosity of less than about 100 cP; and said composition must comprises at least one of either (iii) or (iv).

7. The method according to claim 6 wherein the appropriate refreshing, deodorizing and finishing composition further comprises:

(v) optionally, an effective amount of silicone compounds and/or silicone emulsions;

(vi) optionally, an effective amount of a supplemental wrinkle control agent selected from the group consisting of an adjunct polymer free of carboxylic acid moieties, fabric care saccharides, lithium salts, fabric lubricants, and mixtures thereof;

(vii) optionally, an effective amount of a supplemental surface tension control agent;

(viii) optionally, an effective amount to provide olfactory effects of perfume;

(ix) optionally, an effective amount of solubilized, water-soluble, anti-microbial preservative;

(x) optionally, an effective amount of a humectant; and (xi) optionally, an adjunct ingredients selected from the group consisting of adjunct odor-controlling materials, chelating agents, viscosity control agents, antistatic agents, insect repelling agents, colorants, anti-clogging agents, and mixtures thereof;

wherein said composition must comprises at least one selected from the group consisting of (v), (vi), (vii), (viii), (ix), (x) and (xi).

8. The method according to claim 3 wherein said finish identified in (b) is a soft finish and the appropriate refreshing, deodorizing and finishing composition selected in (d) comprises:

(i) a carrier;

(ii) an effective amount to absorb or reduce malodor, of odor control agent;

(iv) an effective amount of a fabric softener;

wherein said composition has a pH of from about 3 to about 11 and a viscosity of less than about 100 cP.

9. The method according to claim 8 wherein the appropriate refreshing, deodorizing and finishing composition further comprises:

(v) optionally, an effective amount of silicone compounds and/or silicone emulsions;

(vi) optionally, an effective amount of a supplemental wrinkle control agent selected from the group consisting of an adjunct polymer free of carboxylic acid moieties, fabric care saccharides, lithium salts, fabric lubricants, and mixtures thereof;

(vii) optionally, an effective amount of a supplemental surface tension control agent;

(viii) optionally, an effective amount to provide olfactory effects of perfume;

(ix) optionally, an effective amount of solubilized, water-soluble, anti-microbial preservative;

(x) optionally, an effective amount of a humectant; and (xi) optionally, an adjunct ingredients selected from the group consisting of adjunct odor-controlling materials, chelating agents, viscosity control agents, antistatic agents, insect repelling agents, colorants, anti-clogging agents, and mixtures thereof;

wherein said composition must comprises at least one selected from the group consisting of (v), (vi), (vii), (viii), (ix), (x) and (xi).

10. The method according to claim 3 wherein said finish identified in (b) is a crisp finish and said appropriate fabric refreshing, deodorizing and finishing composition selected in (d) comprises:

(i) a carrier;

(ii) an effective amount to absorb or reduce malodor, of odor control agent;

(iii) an effective amount of a wrinkle reducing active, preferably a polymer comprising carboxylic acid moieties, (more preferably homopolymers);

wherein said composition has a pH of from about 3 to about 11 and a viscosity of less than about 100 cP.

11. The method according to claim 9 wherein the appropriate refreshing, deodorizing and finishing composition further comprises:

(v) optionally, an effective amount of silicone compounds and/or silicone emulsions;

(vi) optionally, an effective amount of a supplemental wrinkle control agent selected from the group consisting of an adjunct polymer free of carboxylic acid moieties, fabric care saccharides, lithium salts, fabric lubricants, and mixtures thereof;

(vii) optionally, an effective amount of a supplemental surface tension control agent;

(viii) optionally, an effective amount to provide olfactory effects of perfume;

(ix) optionally, an effective amount of solubilized, water-soluble, anti-microbial preservative;

(x) optionally, an effective amount of a humectant; and (xi) optionally, an adjunct ingredients selected from the group consisting of adjunct odor-controlling materials, chelating agents, viscosity control agents, antistatic agents, insect repelling agents, colorants, anti-clogging agents, and mixtures thereof;

wherein said composition must comprises at least one selected from the group consisting of (v), (vi), (vii), (viii), (ix), (x) and (xi).

12. The method according to claim 1 further comprising step (e) drying said garment.

* * * * *